US010773911B2

(12) United States Patent
Hirata

(10) Patent No.: US 10,773,911 B2
(45) Date of Patent: Sep. 15, 2020

(54) CONVEYOR AND RECORDING APPARATUS INCLUDING SAME

(71) Applicant: BROTHER KOGYO KABUSHIKI KAISHA, Nagoya-shi, Aichi-ken (JP)

(72) Inventor: Kenichi Hirata, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/010,964

(22) Filed: Jun. 18, 2018

(65) Prior Publication Data

US 2019/0047808 A1 Feb. 14, 2019

Related U.S. Application Data

(63) Continuation of application No. 14/670,094, filed on Mar. 26, 2015, now Pat. No. 10,000,350.

(30) Foreign Application Priority Data

Mar. 31, 2014 (JP) ..... 2014-073621

(51) Int. Cl.
*B65H 9/10* (2006.01)
*B65H 5/06* (2006.01)
(Continued)

(52) U.S. Cl.
CPC ..... *B65H 5/062* (2013.01); *B41J 11/0055* (2013.01); *B41J 13/0045* (2013.01); *B65H 9/04* (2013.01)

(58) Field of Classification Search
CPC . B65H 9/004; B65H 9/04; B65H 9/06; B65H 9/101; B65H 9/106; B65H 9/12; B65H 9/16; B65H 9/166; B41J 11/0055
See application file for complete search history.

(56) References Cited

U.S. PATENT DOCUMENTS 3,666,262 A 5/1972 Fowler et al.
5,162,857 A 11/1992 Higeta et al.
(Continued)

FOREIGN PATENT DOCUMENTS

JP 64-019364 A 1/1989
JP 1-271334 A 10/1989
(Continued)

OTHER PUBLICATIONS

Office Action issued in corresponding Japanese Patent Application No. 2014-073621, dated Jan. 24, 2017.

*Primary Examiner* — Thomas A Morrison
(74) *Attorney, Agent, or Firm* — Merchant & Gould P.C.

(57) ABSTRACT

A conveyor comprises a first conveyor roller unit and a side position adjustment mechanism. The side position adjustment mechanism includes a guide member and a position adjustment roller unit. The position adjustment roller unit includes a first position adjustment roller and a second position adjustment roller which holds a sheet-shaped medium with the first position adjustment roller. An angle between a rotational axial line of the first position adjustment roller and a part of a guide face of the guide member which part is on the downstream of an intersection between the rotational axial line of the first position adjustment roller and the guide face is an acute angle. The conveyor further comprises a first support member which supports a first driven roller of the first conveyor roller unit to allow a rotational axial line of the first driven roller to be swingable.

13 Claims, 9 Drawing Sheets

(51) Int. Cl.

| | |
|---|---|
| ***B65H 9/04*** | (2006.01) |
| ***B41J 11/00*** | (2006.01) |
| ***B41J 13/00*** | (2006.01) |

(56) References Cited

U.S. PATENT DOCUMENTS

| | | | | |
|---|---|---|---|---|
| 5,335,904 | A | 8/1994 | Ryuzaki | |
| 5,584,478 | A | 12/1996 | Michels et al. | |
| 5,742,318 | A | 4/1998 | Miyauchi | |
| 8,308,160 | B2 | 11/2012 | Miyazawa | |
| 2007/0284810 | A1 | 12/2007 | Nakazawa et al. | |
| 2010/0327519 | A1 | 12/2010 | Miyazawa | |
| 2012/0091653 | A1 | 4/2012 | Miyazawa | |
| 2012/0321361 | A1* | 12/2012 | Senda ..... | G03G 15/206 399/331 |
| 2013/0135409 | A1 | 5/2013 | Ito et al. | |

FOREIGN PATENT DOCUMENTS

| | | | |
|---|---|---|---|
| JP | H02243436 | A | 9/1990 |
| JP | 3-3842 | A | 1/1991 |
| JP | 3-12832 | U | 8/1991 |
| JP | H0543092 | A | 2/1993 |
| JP | 5-294519 | A | 11/1993 |
| JP | H0616284 | A | 1/1994 |
| JP | 2000233850 | A | 8/2000 |
| JP | 200151387 | A | 6/2001 |
| JP | 2006076673 | A | 3/2006 |
| JP | 2007-161361 | A | 6/2007 |
| JP | 2007326708 | A | 12/2007 |
| JP | 2008184259 | A | 8/2008 |
| JP | 2011006232 | A | 1/2011 |
| JP | 2012086914 | A | 5/2012 |
| JP | 2013043701 | A | 3/2013 |

* cited by examiner

CONVEYOR AND RECORDING APPARATUS INCLUDING SAME

CROSS REFERENCE TO RELATED APPLICATION

The present application is a continuation of U.S. patent application Ser. No. 14/670,094, filed Mar. 26, 2015, which further claims priority from Japanese Patent Application No. 2014-073621, which was filed on Mar. 31, 2014, the disclosure of which is herein incorporated by reference in its entirety.

BACKGROUND OF THE INVENTION

1. Field of the Invention

The present invention relates to: a conveyor capable of performing position adjustment of a sheet-shaped medium; and a recording apparatus including the conveyor.

2. Description of Related Art

There has been known a conveyor for conveying a sheet (recording medium) on which an image is recorded. The conveyor may include an upstream roller pair and a lateral misregistration correcting unit configured to set a sheet at a predetermined width-directional position along a reference plane. The lateral misregistration correcting unit includes a reference plate having the reference plane and a downstream roller pair constituted by a lateral misregistration correction roller and an inclined conveyor roller. The rotation shafts of the paired upstream rollers are both orthogonal to the reference plane, whereas the rotation shaft of the inclined conveyor roller is inclined with respect to the reference plane. The downstream roller pair is positioned between the reference plane and the center of the sheet and is closer to the reference plane than to the center of the sheet, in the width direction of the sheet.

In the conveyor using such a lateral misregistration correcting unit, when the downstream roller pair nips a sheet, to begin with, the sheet rotates so that the tail end of the sheet approaches the reference plane. Thereafter, as the sheet contacts with the reference plane, the sheet reversely rotates on account of the reaction to the contact, so that the leading end of the sheet approaches the reference plane. As a result, the sheet is positioned so that the side edge thereof extends along the reference plane, and the sheet is conveyed along the reference plane. In this way, the correction of the width-directional position of the sheet (so-called side registration) is carried out.

SUMMARY OF THE INVENTION

In the above-described conveyor, the side registration by the downstream roller pair by which the position adjustment is carried out by rotating and reversely rotating the sheet mainly occurs when the sheet is pinched only by the downstream roller pair. To put it differently, because the upstream roller pair always operates to convey the sheet in the direction along the reference plane, the side registration exerted by the downstream roller pair is obstructed by the upstream roller pair when the sheet is pinched by both the upstream roller pair and the downstream roller pair, and hence the side registration may not be properly carried out.

An object of the present invention is to provide a conveyor in which a side registration is less likely to be obstructed, and a recording apparatus including such a conveyor.

A conveyor according to a first aspect of the invention comprises: a first conveyor roller unit which includes a drive roller and a first driven roller which holds a sheet-shaped medium with the drive roller and is rotated in accordance with conveyance of the sheet-shaped medium by rotation of the drive roller; and a side position adjustment mechanism which is positioned downstream of the first conveyor roller unit in a conveyance direction in which the sheet-shaped medium is conveyed by the drive roller. The side position adjustment mechanism includes: a guide member having a guide face which extends in the conveyance direction to be able to contact with one side edge of the sheet-shaped medium; and a position adjustment roller unit which is positioned between the guide face and the center of a conveyance path on which the sheet-shaped medium is conveyed and is closer to the guide face than to the center of the conveyance path, in an axial direction which is in parallel to a rotational axial line of the drive roller. The position adjustment roller unit includes a first position adjustment roller and a second position adjustment roller which holds the sheet-shaped medium with the first position adjustment roller. An angle between a rotational axial line of the first position adjustment roller and a part of the guide face which part is on the downstream in the conveyance direction of an intersection between the rotational axial line of the first position adjustment roller and the guide face is an acute angle. The conveyor further comprises a first support member which supports the first driven roller to allow a rotational axial line of the first driven roller to be swingable.

A recording apparatus according to a second aspect of the invention comprises: a recording unit configured to record an image onto a sheet-shaped medium which is a recording medium; a conveyance unit configured to convey the sheet-shaped medium to cause the sheet-shaped medium to pass a recording position where recording is carried out on the sheet-shaped medium by the recording unit; and a re-conveyance unit configured to re-convey, to a position before passing the recording position, the sheet-shaped medium having been conveyed by the conveyance unit and having passed the recording position. The re-conveyance unit includes the conveyor according to the first aspect of the invention.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

<Overall Structure of Printer>

Figure 1:
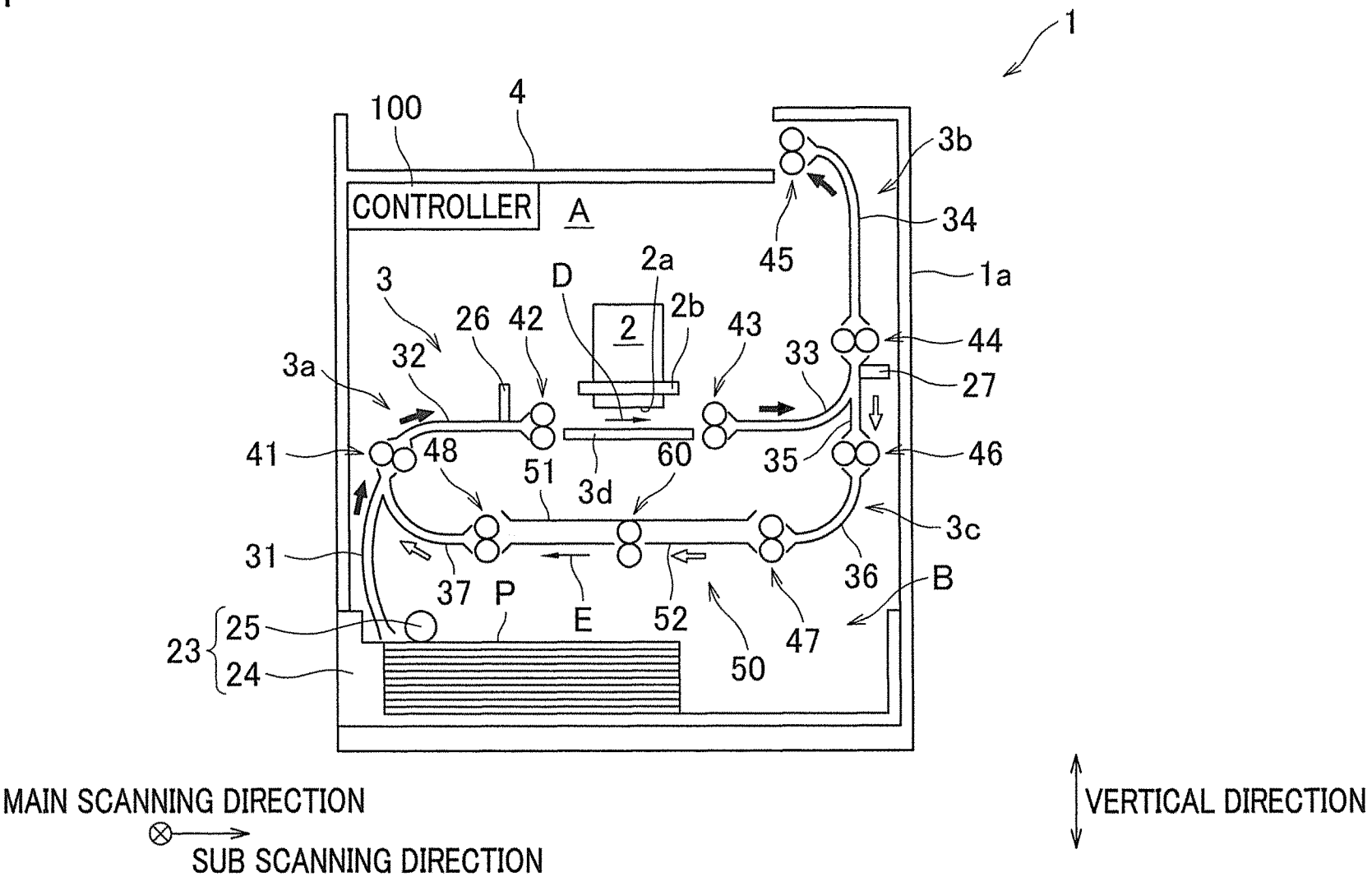
FIG. 1 is a schematic profile showing an internal structure of an inkjet printer including a conveyor of First Embodiment of the present invention.

To begin with, with reference to FIG. 1, the following will describe the overall structure of an inkjet printer 1 which is a recording apparatus including a re-conveyance guide unit which is a conveyor of First Embodiment of the present invention.

The printer 1 includes a rectangular parallelepiped casing 1*a*. At the top plate of the casing 1*a* is provided a sheet output unit 4. The internal space of the casing 1*a* is divided into spaces A and B in this order from above. In the spaces A and B, a sheet conveyance path from a sheet feeding unit 23 toward the sheet output unit 4 and a sheet re-conveyance path from the downstream to the upstream of the sheet conveyance path are formed. As shown in FIG. 1, a sheet P is conveyed along black thick arrows on the sheet conveyance path, and is conveyed along outlined thick arrows on the sheet re-conveyance path. In the space A, image recording onto the sheet P, conveyance of the sheet P to the sheet output unit 4, and re-conveyance of the sheet P are carried out. In the space B, sheet feeding from the sheet feeding unit 23 to the sheet conveyance path is performed.

In the space A, members such as a head (recording unit) 2, a conveyance mechanism 3, and a controller 100 are provided. The head 2 is configured to eject black ink. To the space A, an unillustrated cartridge storing black ink is detachably attached. The cartridge is connected with the head 2 via an unillustrated tube and pump to supply ink to the head 2.

The head 2 is a line-type head which is substantially rectangular parallelepiped in shape and is long in the main scanning direction. The lower surface of the head 2 is an ejection surface 2*a* where ejection openings are formed. In recording, the black ink is ejected from the ejection surface 2*a*. The head 2 is supported by the casing 1*a* via a head holder 2*b*. The head holder 2*b* supports the head 2 so that a predetermined gap suitable for recording is formed between the ejection surface 2*a* and a later-described platen 3*d*.

The conveyance mechanism 3 includes an upstream guide unit 3*a*, a downstream guide unit 3*b*, a re-conveyance guide unit 3*c*, and a platen 3*d*. The platen 3*d* is positioned to oppose the ejection surface 2*a* of the head 2. The platen 3*d* has a flat upper surface, supports the sheet P from below. A recording position where recording is carried out on the sheet P by the head 2 is formed between the flat upper surface of the platen 3*d* and the ejection surface 2*a* of the head 2. The recording position is a part of the sheet conveyance path. The upstream guide unit 3*a* and the downstream guide unit 3*b* are positioned to sandwich the platen 3*d*. The upstream guide unit 3*a* includes two guides 31 and 32 and two conveyor roller units 41 and 42 and connects the recording position with the sheet feeding unit 23. The downstream guide unit 3*b* includes two guides 33 and 34 and three conveyor roller units 43 to 45, and connects the recording position with the sheet output unit 4. The sheet conveyance path is defined by the four guides 31 to 34, the platen 3*d*, and the head 2.

The re-conveyance guide unit 3*c* includes three guides 35 to 37, three conveyor roller units 46 to 48 (including later-described first conveyor roller unit 47 and second conveyor roller unit 46), and a side position adjustment mechanism 50 having a so-called side registration, and connects the downstream guide unit 3*b* with the upstream guide unit 3*a* while circumventing the recording position. The guide 35 is connected to a non-end part of the guide 33 to connect the re-conveyance guide unit 3*c* with the downstream guide unit 3*b*. The guide 37 is connected to a non-end part of the guide 31 to connect the re-conveyance guide unit 3*c* with the upstream guide unit 3*a*. The sheet re-conveyance path is defined by the three guides 35 to 37 and the side position adjustment mechanism 50.

Each of the above-described conveyor roller units 41 to 48 is made up of a drive roller and a plurality of driven rollers which holds the sheet P with the drive roller and are rotated in accordance with the conveyance of the sheet P by the rotation of the drive roller. In the present embodiment, the drive rollers of the conveyor roller units 41 to 45 are rollers that contact with a surface of the sheet P conveyed from the sheet feeding unit 23 to the sheet output unit 4 without passing the sheet re-conveyance path, the surface opposing the platen 3*d* and no recording being performed thereon. The drive rollers of the conveyor roller units 46 to 48 are rollers which contact with a surface of the sheet P supplied to the sheet re-conveyance path on which surface no recording is performed. (i.e., contact with a surface of the sheet P to be supplied to the sheet conveyance path, which surface opposes the ejection surface 2*a*). Examples of the drive rollers include rubber rollers and resin rollers. Details of the conveyor roller units 46 and 47 will be given later.

In the present embodiment, the upstream guide unit 3*a*, the downstream guide unit 3*b*, the platen 3*d*, and the conveyor roller units 41 to 45 constitute a conveyance unit which conveys the sheet P to cause the sheet P to pass the recording position. Furthermore, the re-conveyance guide unit 3*c* constitutes a re-conveyance unit which re-conveys, to a position before passing the recording position, the sheet P having been conveyed by the conveyance unit and having already passed the recording position.

The drive roller of the conveyor roller unit 44 is controlled by the controller 100 so that the conveyance direction of the sheet P is switched. To put it differently, the drive roller of the conveyor roller unit 44 rotates to convey the sheet P upward when the sheet P is conveyed from the recording position toward the sheet output unit 4. In the meanwhile, when the sheet P is conveyed from the sheet conveyance path to the sheet re-conveyance path, the rotational direction of this drive roller is switched so that the sheet P is conveyed downward with the tail end of the sheet P being the leading end, when the tail end of the sheet P is positioned between the junction of the guides 33 and 35 and the conveyor roller unit 44 and the tail end is detected by the sheet sensor 27. The sheet P having been conveyed from the sheet conveyance path to the sheet re-conveyance path is re-conveyed to the upstream guide unit 3*a*. The re-conveyed sheet P conveyed to the recording position again is reversed as compared to the sheet P having passed the recording position for the first time. In this way, images are formed on the respective surfaces of the sheet P.

In the sheet re-conveyance path, the three conveyor roller units 46 to 48 are positioned in this order from the upstream. The side position adjustment mechanism 50 is positioned downstream of the conveyor roller unit 47 and upstream of the conveyor roller unit 48 in the conveyance direction E of the sheet P conveyed by the drive roller of the conveyor roller unit 47, i.e., the side position adjustment mechanism 50 is positioned between the conveyor roller units 47 and 48. In the vertical direction, the side position adjustment mechanism 50 is positioned between the recording position and the sheet feeding unit 23 (specifically, positioned between the platen 3*d* and the sheet feeding unit 23). The side position adjustment mechanism 50 includes an upper guide 51, a lower guide 52 (guide member), and a position adjustment roller unit 60. The side position adjustment mechanism 50 performs the positioning of the sheet P in the width direction in such a way as to convey the sheet P while causing side edge in the width direction of the sheet P having conveyed between the guides 51 and 52 (i.e., side edges in the orthogonal direction which is the main scanning direction and is orthogonal to the conveyance direction E of the sheet P) to contact a guide face 54*a*1 (see FIG. 2). The details of the side position adjustment mechanism 50 will be given later.

In the space B is provided the sheet feeding unit 23. The sheet feeding unit 23 includes a sheet tray 24 and a pickup roller 25. The sheet tray 24 is detachable to the casing 1*a*. The sheet tray 24 is an open top box and is able to store sheets P which are positionally adjusted with reference to the center (so that the center of each sheet P in the width direction corresponds to a later-described center line C1). The pickup roller 25 sends out the topmost sheet P in the sheet tray 24.

The sub scanning direction is a direction in parallel to the conveyance direction D in which a sheet is conveyed by the conveyor roller units 42 and 43 and in parallel to the conveyance direction E in which a sheet is conveyed by the conveyor roller units 47 and 48. The main scanning direction is a direction in parallel to the horizontal plane and orthogonal to the sub scanning direction, and is in parallel to a later-described axial direction (i.e., the direction of axial lines M1, M2, and M3).

Now, the controller 100 will be described. The controller 100 controls the overall operations of the printer 1 by controlling operations of components of the printer 1. The controller 100 controls a recording operation based on a recording command supplied from an external apparatus (e.g., a PC connected to the printer 1). To be more specific, the controller 100 controls operations such as conveyance of a sheet P and ink ejection in sync with the conveyance of the sheet P.

When, for example, a recording command instructing to perform recording on one surface of a sheet P is received from the external apparatus, the controller 100 drives, based on the recording command, the sheet feeding unit 23 and the drive rollers of the conveyor roller units 41 to 45 by using an unillustrated drive mechanism (constituted by members such as a drive motor and a gear transferring a rotational force of the drive motor). The sheet P sent out from the sheet tray 24 is guided by the upstream guide unit 3*a* and is sent to the recording position (between the platen 3*d* and the head 2). When the sheet P passes a position directly below the head 2, the head 2 is controlled by the controller 100 so that ink droplets are ejected from the head 2. With this, a desired image is formed on a surface of the sheet P. A timing to eject ink is determined based on a detection signal from a sheet sensor 26. The sheet sensor 26 is positioned upstream of the head 2 in the conveyance direction D to detect the leading end of each sheet P. The sheet P on which the image has been recorded is guided by the downstream guide unit 3*b* and is ejected to the sheet output unit 4 from an upper part of the casing 1*a*.

When, for example, receiving a recording command instructing to perform recording on both surfaces of the sheet P from the external apparatus, the controller 100 drives, based on the recording command, the sheet feeding unit 23 and the drive rollers of the conveyor roller units 41 to 45 by using the unillustrated drive mechanism. To begin with, as with the single-surface recording, an image is formed on the surface of the sheet P and the sheet P is conveyed toward the sheet output unit 4. As shown in FIG. 1, a sheet sensor 27 is positioned upstream of and close to the conveyor roller unit 44. When the sheet sensor 27 detects the tail end of the sheet P, the drive roller of the conveyor roller unit 44 reversely rotates under the control of the controller 100, so that the direction of the conveyance of the sheet P is reversed. At this stage, the drive rollers of the conveyor roller units 46 to 48 (including the drive rollers 111 and 121 of later-described roller units 46 and 47 (see FIG. 2)) and the drive roller 61 of the position adjustment roller unit 60 (see FIG. 2) are also driven. As a result, the path of the sheet P is switched and the sheet P is conveyed along the sheet re-conveyance path (indicated by the outlined arrows). At this stage, the side position adjustment mechanism 50 performs the positioning of the sheet P in the main scanning direction, and the positioned sheet P is re-conveyed to the recording position. The sheet P having been reversed and re-conveyed from the sheet re-conveyance path to the upstream guide unit 3*a* is supplied again to the recording position, and an image is recorded on the back surface. When the leading end of the sheet P is detected by the sheet sensor 26 prior to the image recording on the back surface, the rotation of the drive roller of the conveyor roller unit 44 is returned to the regular rotation. The sheet P having the surfaces for both of which the recording has been done is ejected to the sheet output unit 4 via the downstream guide unit 3*b*.

<Outline of First and Second Conveyor Roller Units>

Figure 2:
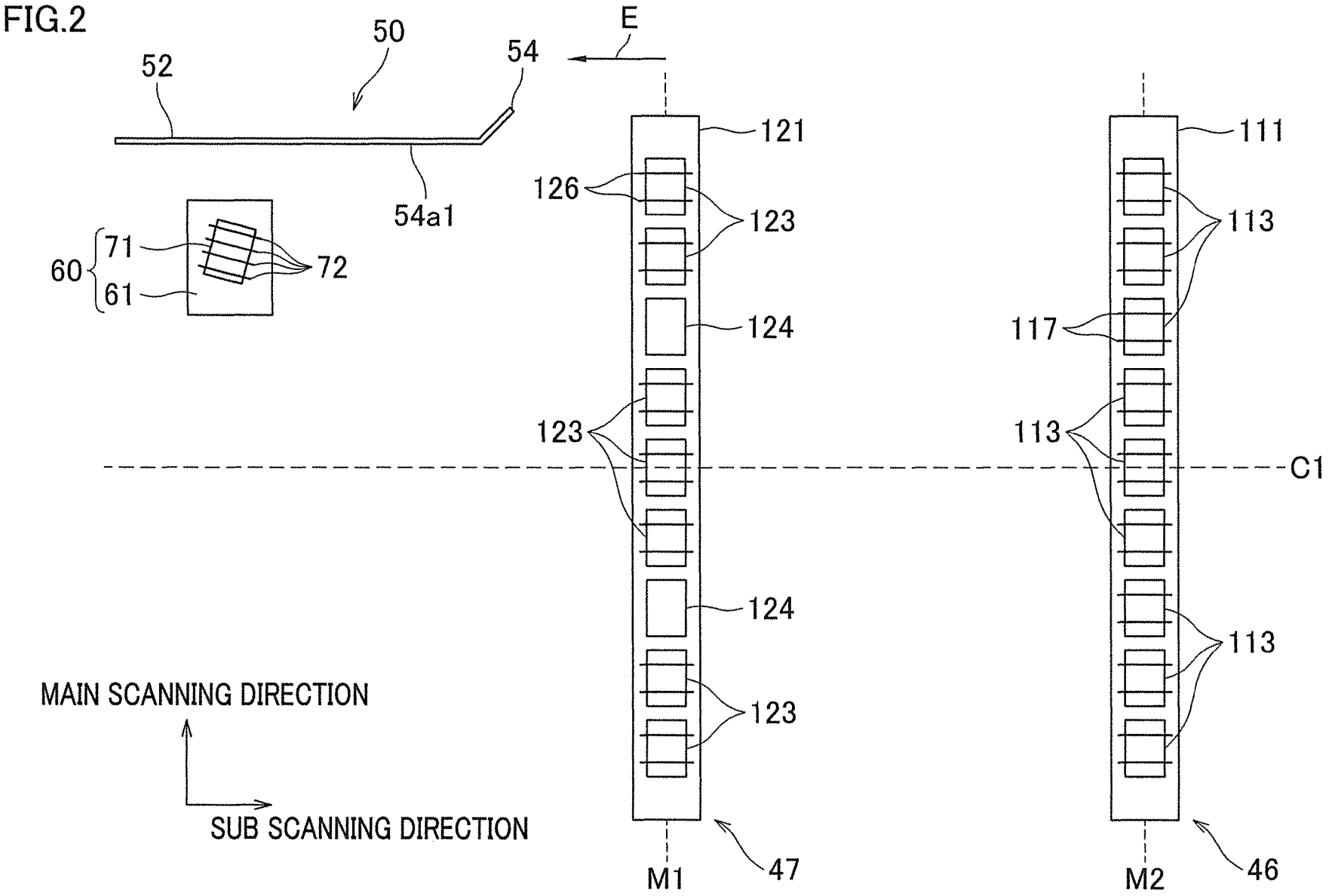
FIG. 2 is a virtual plan view showing the positional relationship between two conveyor roller units which are along a sheet re-conveyance path and a side position adjustment mechanism in the printer shown in FIG. 1.

Now, referring to FIG. 2, the outline of the first conveyor roller unit 47 and the second conveyor roller unit 46 will be described. FIG. 2 is a virtual plan view showing the positional relationship between the two conveyor roller units 46 and 47 along the sheet re-conveyance path and the side position adjustment mechanism 50. In FIG. 2, a path between the conveyor roller units 46 and 47 is indicated to extend along the conveyance direction E.

As shown in FIG. 2, the conveyor roller units 46 and 47 have drive rollers 111 and 121, respectively. Each of the drive rollers 111 and 121 is longer than the width of a sheet Pmax which is the maximum-sized sheet which can be conveyed at the side position adjustment mechanism 50. The drive rollers 111 and 121 are identical in length and the axes thereof (i.e., axial lines M1 and M2 which are in parallel to each other) are orthogonal to the conveyance direction E. The drive rollers 111 and 121 are driven by an unillustrated drive mechanism.

The first conveyor roller unit 47 further includes nine driven rollers 123 and 124 which are lined up at regular intervals to form a single line in the axial direction. The drive roller 121 opposes the nine driven rollers 123 and 124. Seven driven rollers (hereinafter, first driven rollers 123) which are partial rollers and are not the third and seventh rollers among the nine driven rollers are supported by a later-described first support member 130 so that the rotational axial lines of these seven driven rollers are swingable (see FIG. 5A). To the outer circumferential surface of each first driven roller 123, two spurs 126 are attached. The details of the spurs 126 will be given later. The third and seventh driven rollers (hereinafter, second driven rollers 124) are supported by the first support member 130 so that the rotational axial lines of these two driven rollers are in parallel to the rotational axial line of the drive roller 121 and do not swing (see FIG. 5D). The separation distance between the first conveyor roller unit 47 and the position adjustment roller unit 60 in the conveyance direction E is shorter than the length in the conveyance direction E of a sheet Pmin and is longer than a half of the length of the sheet Pmin in the conveyance direction E. The sheet Pmin is the minimum-sized sheet which can be conveyed at the side position adjustment mechanism 50.

The second conveyor roller unit 46 further includes nine driven rollers (upstream driven rollers) 113 which are partial rollers and are lined up at regular intervals to form a single line in the axial direction. The drive roller 111 (upstream drive roller) opposes the nine upstream driven rollers 113. Each of the rotational axial lines of the driven rollers 113 are in parallel to the rotational axial line of the drive roller 111. The nine driven rollers 113 are supported by a second support member 150 so that the each of the rotational axial lines of the driven rollers 113 does not swing. The second support member 150 is identical in terms with the structure with a part of the first support member 130 supporting the second driven rollers 124. To the outer circumferential surface of each upstream driven roller 113, two spurs 117 which are identical in terms of the structure with the spurs 126 are attached. In the present embodiment, the side edges of the maximum-sized sheet Pmax are positioned to correspond to the driven rollers 113 and 123 which are the outermost ones of the nine driven rollers, in each of the conveyor roller units 46 and 47. The separation distance between the second conveyor roller unit 46 and the position adjustment roller unit 60 in the conveyance direction E is shorter than the length of the sheet Pmax in the conveyance direction E and longer than a half of the length of the sheet Pmax in the conveyance direction E. Furthermore, the separation distance is longer than the length of the sheet Pmin in the conveyance direction E.

<Side Position Adjustment Mechanism>

Now, the side position adjustment mechanism 50 will be described referring further to FIG. 3. The upper guide 51 and the lower guide 52 of the side position adjustment mechanism 50 are both plate-shaped components and are distanced from each other in the vertical direction. The space between these guides 51 and 52 corresponds to "the conveyance path" of the present invention and forms a part of the sheet re-conveyance path.

The position adjustment roller unit 60 includes a driven roller 71 (first position adjustment roller) and a drive roller 61 (second position adjustment roller) which is positioned below the first position adjustment roller 71 to hold a sheet P with the first position adjustment roller 71. In the main scanning direction, the position adjustment roller unit 60 is positioned between the guide face 54*a*1 and the center of the conveyance path and is closer to the guide face 54*a*1 than to the center of the conveyance path. Here, the center of the conveyance path corresponds to the center line C1 indicated by a broken line in FIG. 2. The first position adjustment roller 71 is driven either by the rotation of the drive roller 61 or in accordance with the conveyance of a sheet P conveyed by the drive roller 61.

Figure 3:
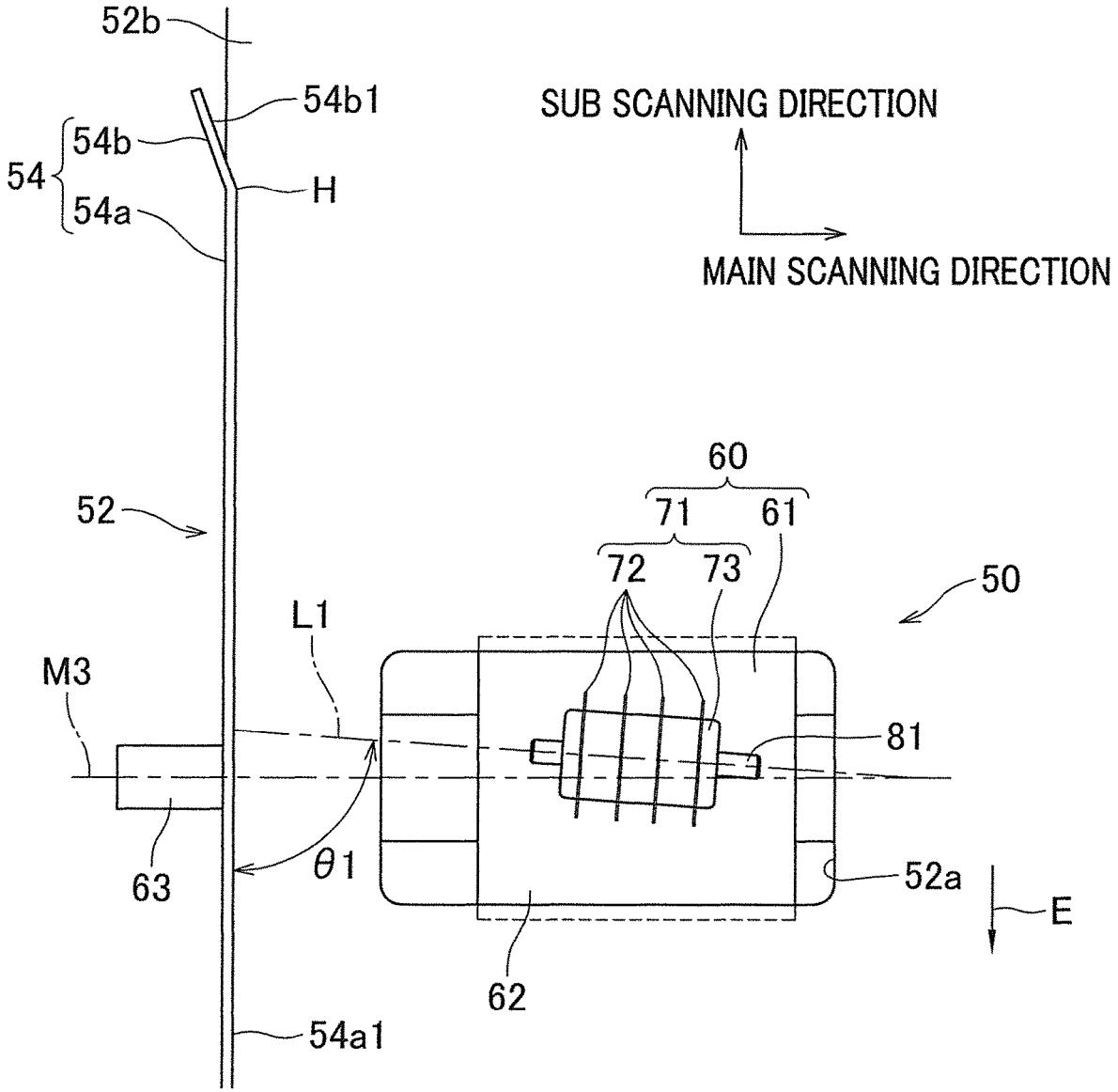
FIG. 3 is a plan view showing the details of the side position adjustment mechanism shown in FIG. 2.

As shown in FIG. 3, the lower guide 52 has a hole 52*a* which penetrates the lower guide 52 in the thickness direction. The hole 52*a* is slightly smaller than the drive roller 61 in plan view. The lower guide 52 has a conveyance surface 52*b* which supports the lower surface of a conveyed sheet P. At one end in the main scanning direction of the lower guide 52, a vertical portion 54 is formed to extend in the vertical direction. This vertical portion 54 includes an extending portion 54*a* which extends in the sub scanning direction and a tapered portion 54*b*. The extending portion 54*a* has a guide face 54*a*1 which is a vertical surface in which the sub scanning direction is one of the in-plane directions thereof. The guide face 54*a*1 is a side surface of the extending portion 54*a* which surface faces the position adjustment roller unit 60. The guide face 54*a*1 is configured to contact with one side edge of a sheet P. In the conveyance direction E, the tapered portion 54*b* is connected to the upstream end portion of the extending portion 54*a*. The tapered portion 54*b* has a tapered face 54*b*1 which intersects with the guide face 54*a*1. The tapered face 54*b*1 is a side surface of the tapered portion 54*b* which surface faces the position adjustment roller unit 60. The tapered face 54*b*1 is connected to the guide face 54*a*1 at a border line H.

In the present embodiment, the first position adjustment roller 71 is positioned to overlap the guide face 54*a*1 in the conveyance direction E. With this arrangement, the sheet P is certainly brought onto the guide face 54*a*1 by the position adjustment roller unit 60. Provided that the first position adjustment roller 71 is positioned upstream or downstream of the guide face 54*a*1 in the conveyance direction E, the distance in which the sheet P is conveyed while contacting with the guide face 54*a*1 is short, and hence the sheet P is less likely to be sufficiently brought onto the guide face 54*a*1.

The drive roller 61 includes a cylindrical roller main body 62 and a shaft 63 which rotates together with the roller main body 62. The roller main body 62 is positioned to oppose the hole 52*a* and to be below the first position adjustment roller 71. The upper end of the roller main body 62 slightly protrudes upward from the conveyance surface 52*b* of the lower guide 52, and contacts with the lower surface of a sheet P conveyed to the conveyance surface 52*b*. The shaft 63 is fixed to the roller main body 62 in the state of being inserted into the roller main body 62, and functions as a rotation shaft of the drive roller 61. The shaft 63 is rotatably supported by the casing 1*a*. The side position adjustment mechanism 50 is driven by the above-described drive mechanism. This drive mechanism is driven under the control of the controller 100, and rotates the roller main body 62 via the shaft 63. An axial line M3 (in parallel to the above-described two axial lines M1 and M2) of the shaft 63 is in parallel to the main scanning direction. To put it differently, the axial line M3 of the shaft 63 is orthogonal to the guide face 54*a*1. This simplifies the structure of the drive mechanism. Provided that the axial line M3 of the shaft 63 intersects with the main scanning direction, components of the drive mechanism such as a gear must correspond to the inclination of the axial line M3, and hence the structure of the drive mechanism becomes complicated.

As shown in FIG. 3, the first position adjustment roller 71 includes a cylindrical roller main body 73 and four spurs 72 on the outer circumferential surface of the roller main body 73. The first position adjustment roller 71 overlaps the guide face 54*a*1 in the conveyance direction E. Each of the spurs 72 is a thin plate in shape and includes an annular portion attached to the outer circumferential surface of the roller main body 73 and protrusions protruding outward from the annular portion. Each of the protrusions narrows toward a point. With this arrangement, as the sharp points of the protrusions of the first position adjustment roller 71 contact with the sheet P in a piercing manner, the first position adjustment roller 71 rotates in accordance with the conveyance of the sheet P. The spurs 72 are identical in terms of the structure with the spurs 126 of the first driven roller 123 (see FIG. 5C).

The first position adjustment roller 71 is supported to be rotatable about the shaft by a supporting mechanism including a shaft 81 which is inserted into and fixed to the roller main body 73. This supporting mechanism is attached to the lower surface of the upper guide 51 and includes a spring which is a biasing member (e.g., an elastic member such as a coil spring). On this account, the supporting mechanism is able to press the first position adjustment roller 71 contacting with the drive roller 61 downward toward the drive roller 61. As a result, a predetermined nipping force for holding the sheet P is generated between the first position adjustment roller 71 and the drive roller 61. This restrains the slipping of the sheet P with respect to the drive roller 61, and the sheet P is conveyed in the conveyance direction E.

As shown in FIG. 3, the first position adjustment roller 71 is supported by the supporting mechanism in such a way that an angle θ1 between the axial line L1 and a part of the guide face 54*a*1, which part is on the downstream in the conveyance direction E of an intersection between the axial line L1 of the shaft 81 and the guide face 54*a*1, is an acute angle (e.g., 85 to 89 degrees, preferably 88 degrees). With this arrangement, the sheet P sandwiched between the first position adjustment roller 71 and the drive roller 61 receives a force with which the side edge of the sheet P is positioned along the guide face 54*a*1, in accordance with the rotation of the drive roller 61.

In the present embodiment, the vertical portion 54 of the lower guide 52 and the position adjustment roller unit 60 are movable in the main scanning direction by an unillustrated mechanism, in accordance with an operation by the user. On the assumption that the center of the sheet P in the width direction corresponds to the center line C1, the user moves the guide face 54*a*1 in the main scanning direction in accordance with the size of the sheets P stored in the sheet tray 24 so that the position of the side edge of each sheet P corresponds to the guide face 54*a*1 in the main scanning direction.

<First Support Member of First Conveyor Roller Unit>

Figure 4:
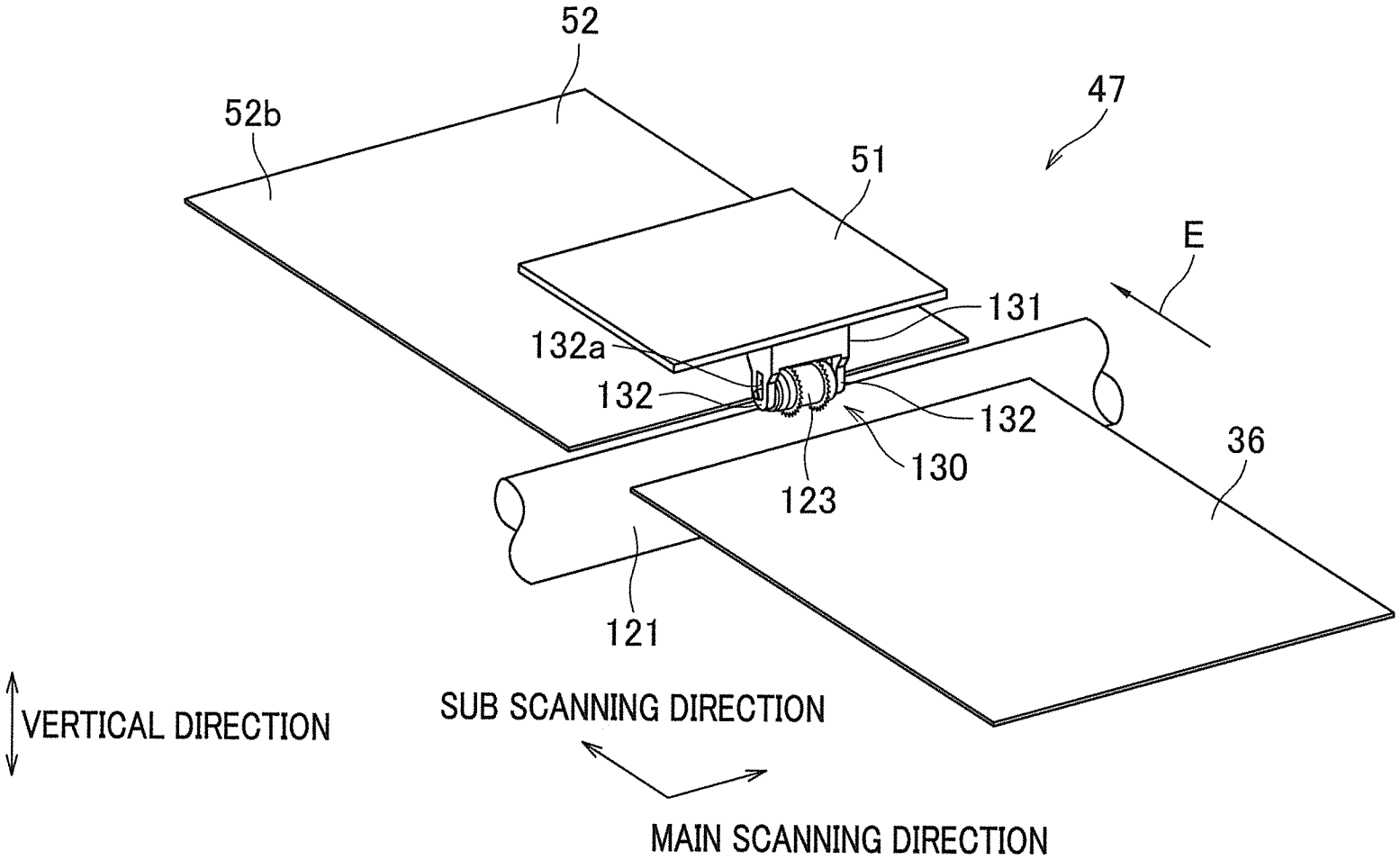
FIG. 4 is a partial oblique perspective of the first conveyor roller unit shown in FIG. 2.

Now, the structure of the first support member 130 of the conveyor roller unit 47 will be described referring further to FIG. 4 and FIGS. 5A to 5D. FIG. 4 is a partial oblique perspective of the conveyor roller unit 47 in which only one first driven roller 123 is depicted. FIGS. 5A to 5D are drawings for explaining the first driven roller 123 and an important part of the first support member 130 and for explaining the second driven roller 124 and an important part of the first support member 130. While FIG. 4 shows that the first support member 130 supports only one first driven roller 123, the first support member 130 actually supports the seven first driven rollers 123 and the two second driven rollers 124 as described below.

As shown in FIG. 4, the first conveyor roller unit 47 includes the first support member 130 supporting the first driven rollers 123. The first support member 130 has nine supporter main bodies 131 (FIG. 4 shows only one of them) attached to the lower surface of the upper guide 51. On the lower surface of each supporter main body 131, a pair of flanges 132 is formed to protrude downward. In each flange 132, a long hole 132*a* which is narrow and vertically long is formed.

Figure 5A:
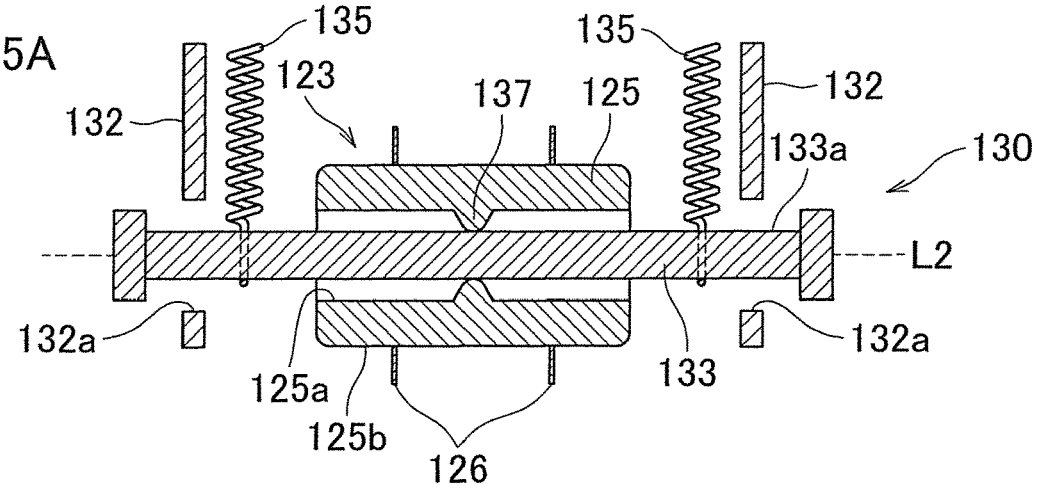
FIGS. 5A to 5D show a first driven roller and a second driven roller in the first conveyor roller unit and an important part of a first support member.
Figure 5B:
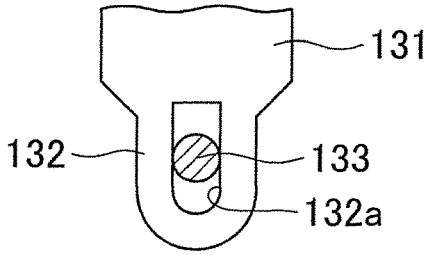

As shown in FIG. 5A, the first support member 130 further includes, for each first driven roller 123, a supporting shaft 133 (shaft) which horizontally extends and a pair of coil springs 135 which are elastic members positioned between the supporter main body 131 and the supporting shaft 133. The supporting shaft 133 is inserted into the long holes 132*a* at the both ends. As shown in FIG. 5B, the supporting shaft 133 is vertically movable within the range of each long hole 132*a*. Between the flanges 132 and the first driven roller 123, the coil springs 135 are connected to the supporter main body 131 and the supporting shaft 133.

As shown in FIG. 5A, the first driven roller 123 includes a cylindrical roller main body 125 and two spurs 126. The roller main body 12 has a through hole 125*a* which horizontally extends. The two spurs 126 are attached to the outer circumferential surface 125*b* of the roller main body 125. The inner circumferential surface of the first driven roller 123 defines the through hole 125*a*. At a central part of the inner circumferential surface of the first driven roller 123, an annular protrusion 137 is provided together with the roller main body 125. The annular protrusion 137 is a part of the first support member 130. The protrusion 137 forms, in the through hole 125*a*, a circular opening which is smaller in diameter than the through hole 125*a*. The inner diameter of this circular opening is substantially identical with the outer diameter of the supporting shaft 133.

The supporting shaft 133 is inserted into the through hole 125*a*, and the outer circumferential surface 133*a* of the supporting shaft 133 contacts with the leading end of the protrusion 137 throughout the range of 360 degrees. In the meanwhile, the outer circumferential surface 133*a* of the supporting shaft 133 does not contact with the inner circumferential surface of the first driven roller 123 which surface faces the through hole 125*a*, and a gap is formed therebetween. As a result, the leading end of the protrusion 137 functions a a fulcrum of the swing of the roller main body 125 with respect to the supporting shaft 133. That is to say, the first driven roller 123 is swingable about the leading end of the protrusion 137 to the extent that the inner circumferential surface of the first driven roller 123 does not contact with the outer circumferential surface 133*a* of the supporting shaft 133. Each first driven roller 123 is supported so that the rotational axial line L2 thereof swings, in a plane which is orthogonal to a plane including the rotational axial line of the drive roller 121 and a tangent of the drive roller 121 and the first driven roller 123. To put it differently, the orthogonal plane includes the rotational axial line of the drive roller 121 and the conveyance direction E. To put it further differently, the orthogonal plane is in parallel to the sheet P conveyed by the first conveyor roller unit 47 and is in parallel to the conveyance surface 52*b*. When a later-described θ2 is 90 degrees, the rotational axial line L2 of the first driven roller 123 (the central axis of the through hole 127*a*) is in parallel to the axial direction of the drive roller 121. Furthermore, in the present embodiment, the supporter main body 131, the flanges 132, the supporting shaft 133, the coil springs 135, and the protrusion 137 are provided independently for each first driven roller 123. For this reason, the first support member 130 supports the seven first driven rollers 123 so that the rotational axial lines L2 of the seven first driven rollers 123 independently swing. Furthermore, the supporting shaft 133 supports the roller main body 125 at the leading end of the protrusion 137 so that the roller main body 125 is rotatable about the shaft.

Figure 5C:
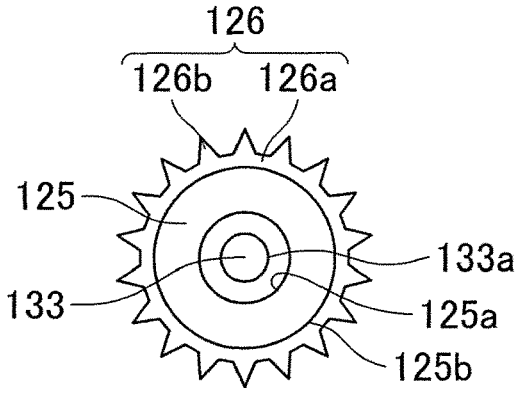

As shown in FIG. 5C, each of the spurs 126 is a flat plate in shape and has an annular portion 126*a* attached to the outer circumferential surface 125*b* of the roller main body 125 and protrusions 126*b* protruding outward from the annular portion 126*a*. Each of the protrusion 126*b* is narrowed toward a point. With this arrangement, as the sharp points of the protrusion 126*b* contact with the sheet P in a piercing manner, the first driven roller 123 rotates in accordance with the conveyance of the sheet P.

The pair of coil springs 135 biases the supporting shaft 133 downward when the first driven roller 123 contacts with the drive roller 121. The biasing force of the coil springs 135 generates a pressure from the first driven roller 123 to the drive roller 121.

Figure 5D:
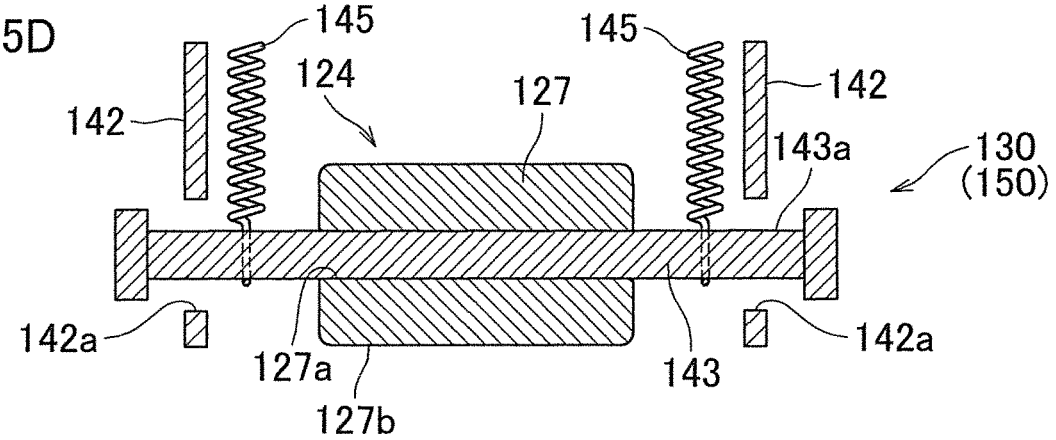

As shown in FIG. 5D, at a part of the first support member 130 which part supports the second driven roller 124, a pair of flanges 142 protruding downward is formed at the lower surface of the supporter main body 131. Each of the flanges 142 has a long hole 142*a* which is narrow and long in the vertical direction.

In addition to the above the first support member 130 includes, for each second driven roller 124, a supporting shaft 143 (shaft) which horizontally extends and a pair of coil springs 145 which are elastic members positioned between the supporter main body and the supporting shaft 143. The supporting shaft 143 is inserted into the long holes 142*a* at the both ends. The supporting shaft 143 is vertically movable within the range of each long hole 142*a*. Between the flanges 142 and the second driven roller 124, the coil springs 145 are connected to the supporter main body and the supporting shaft 143.

The second driven roller 124 includes a cylindrical roller main body 127 in which a horizontally-extending through hole 127*a* is formed. The inner diameter of the through hole 127*a* is slightly longer than the outer diameter of the supporting shaft 143, and the supporting shaft 143 is inserted into the through hole 127*a*. With this, the second driven roller 124 does not swing and is supported by the supporting shaft 143 to be rotatable about the shaft. The rotational axial line of the second driven roller 124 (i.e., the central axis of the through hole 127*a*) is always in parallel to the axial direction of the drive roller 121. No spur is attached to the outer circumferential surface of the second driven roller 124 because a sheet tends to be damaged in a later-described positioning operation when a spur is provided on the second driven roller 124 which do not swing.

The pair of the coil springs 145 biases the supporting shaft 143 downward while the second driven roller 124 contacts with the drive roller 121. The biasing force of the coil springs 145 generates a pressure from the second driven roller 124 to the drive roller 121. In the present embodiment, spring constants of the coil springs 135 and 145 are adjusted so that the pressure from the second driven roller 124 to the drive roller 121 is smaller than the pressure from the first driven roller 123 to the drive roller 121.

As described above, the second support member 150 supporting the upstream driven rollers 113 is structurally identical with a part of the first support member 130 which part supports the second driven roller 124 (FIG. 5D). As with the first support member 130, the pressure from the upstream driven rollers 113 to the upstream drive roller 111 is generated by a biasing force of the coil springs. In the present embodiment, as the spring constants of the coil springs 145 and the coil springs in the second support member 150 supporting the upstream driven rollers 113 are adjusted, the pressure from the first driven rollers 123 to the drive roller 121 is smaller than the pressure from the upstream driven rollers 113 to the upstream drive roller 111. Furthermore, on the outer circumferential surface of the upstream driven roller 113, two spurs 117 which are identical with the spurs 126 shown in FIG. 5C are attached.

<Positioning Operation for Sheet in Sheet Re-Conveyance Path>

Now, a positioning operation (side registration) for a sheet P conveyed on the sheet re-conveyance path will be described referring further to FIGS. 6A to 6D. The description below assumes that a sheet P which is relatively long in the conveyance direction and is equal to or longer than the distance between the second conveyor roller unit 46 and the position adjustment roller unit 60 in length is used. The positioning operation described below, however, remains the same even if a sheet P which is relatively short in the conveyance direction and is shorter than the distance between the second conveyor roller unit 46 and the position adjustment roller unit 60 is used.

Figure 6A:
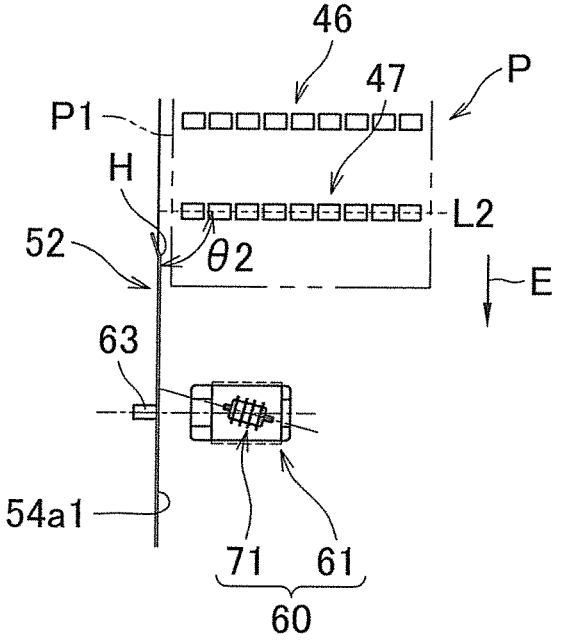
FIGS. 6A to 6D are plan views showing a positioning operation of a sheet in First Embodiment of the present invention step by step.

To begin with, the sheet P is conveyed from the second conveyor roller unit 46 to the first conveyor roller unit 47. At this stage, the seven first driven rollers 123 of the first conveyor roller unit 47 are rotating in accordance with the rotation of the drive roller 121. For this reason, as shown in FIG. 6A, the rotational axial line L2 of each first driven roller 123 is inclined with the respect to the supporting shaft 133 so that the rotational axial line L2 of each first driven roller 123 is in parallel to the axial line M1 of the drive roller 121. As a result, the rotational axial line L2 and a part of the guide face 54*a*1 which part is on the downstream in the conveyance direction E of an intersection between the rotational axial line L2 and a virtual flat plane including the guide face 54*a*1 form an angle θ2 of substantially 90 degrees (right angle). On this account, at the contact point between each first driven roller 123 and the drive roller 121, the rotational direction of the first driven roller 123 is substantially identical with the rotational direction of the drive roller 121. As a result, the load from each first driven roller 123 to the sheet P is reduced.

The two second driven rollers 124 do not swing and the rotational axial lines thereof are always orthogonal to the virtual flat plane including the guide face 54*a*1. For this reason, even if the first driven rollers 123 are inclined for some reason so that the angle θ2 becomes not at 90 degrees, the second driven rollers 124 always apply a force by which the sheet P is conveyed in the conveyance direction E to the sheet P, with the result that the rotation of the sheet P or the movement of the sheet P in the main scanning direction before the leading end of the sheet P reaches the position adjustment roller unit 60 are restrained.

Figure 6B:
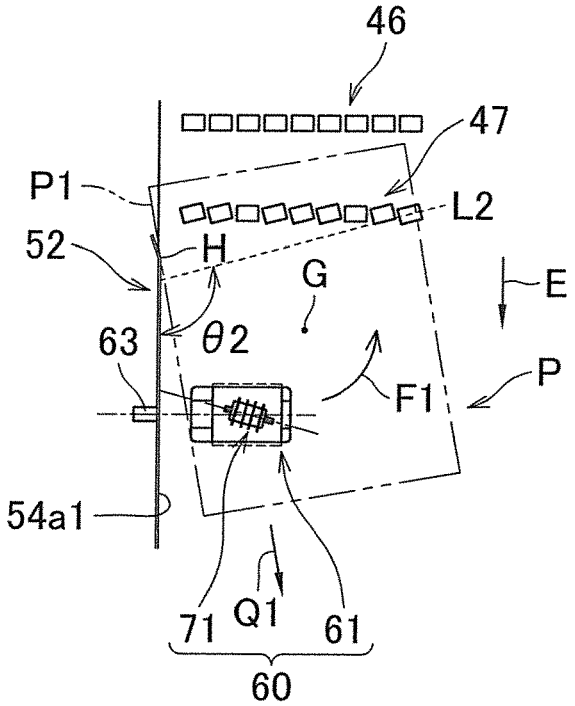

When the leading end of the sheet P reaches the position adjustment roller unit 60 and the tail end of the sheet P has passed the second conveyor roller unit 46, the sheet P is conveyed while being pinched by the position adjustment roller unit 60. At this stage, as shown in FIG. 6B, the position adjustment roller unit 60 holds the left part of the sheet P, and hence an angular moment around the center of gravity of the sheet P is generated in the sheet P. As a result, the sheet P is conveyed by the position adjustment roller unit 60 and the two conveyor roller units 46 and 47 in the conveyance direction E while rotating in a rotational direction F1 (counterclockwise rotation in the figure) about the center of gravity G, until a side P1 of the sheet P which side faces the guide face 54*a*1 contacts with the border line H between the guide face 54*a*1 and the tapered face 54*b*1.

In regard to the above, the rotational axial line L2 of each first driven roller 123 which contacts with the sheet P and rotates in accordance with the conveyance of the sheet P changes its angle with respect to the supporting shaft 133 by following the traveling direction Q1 of the sheet P (i.e., a direction formed by synthesizing the rotational direction F1 at the contact point between the spur 126 and the sheet P and the conveyance direction E). To be more specific, the rotational axial line L2 of the first driven roller 123 is inclined with respect to the supporting shaft 133 so that the direction of the rotational axial line L2 of the first driven roller 123 becomes close to a direction orthogonal to the traveling direction Q1 of the sheet P. In other words, the angle θ2 is an obtuse angle. For this reason, at the contact point between each first driven roller 123 and the sheet P, the rotational direction of the first driven roller 123 becomes close to the traveling direction Q1 of the sheet P. As a result, the load from the first driven rollers 123 to the sheet P is reduced and hence the rotation of the sheet P is less likely to be obstructed, with the result that the sheet P easily rotates.

Figure 6C:
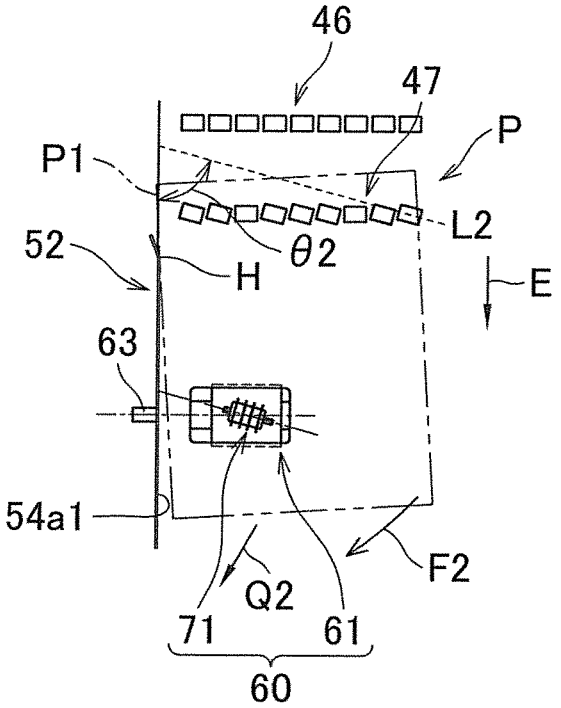

The side P1 of the sheet P then contacts with the border line H. When the sheet P is further conveyed by the position adjustment roller unit 60 and the conveyor roller unit 47 while the side P1 of the sheet P is contacting with the border line H, as shown in FIG. 6C, an angular moment is generated in the sheet P with the border line H functioning as a rotation center. As a result, the sheet P is conveyed by the position adjustment roller unit 60 and the conveyor roller unit 47 in the conveyance direction E while rotating in the rotational direction F2 (clockwise direction in the figure) about the border line H, until the leading end of the sheet P (the leading end of the side P1) contacts with the guide face 54*a*1. At this stage, the rotational axial line L2 of each first driven roller 123 changes its angle with respect to the supporting shaft 133 by following the traveling direction Qw of the sheet P (i.e., a direction formed by synthesizing the rotational direction F2 at the contact point between the spur 126 and the sheet P and the conveyance direction E). To be more specific, the rotational axial line L2 of the first driven roller 123 is inclined with respect to the supporting shaft 133 so that the direction of the rotational axial line L2 of the first driven roller 123 becomes close to a direction orthogonal to the traveling direction Q2 of the sheet P. In other words, the angle θ2 is an acute angle. On this account, at the contact point between the first driven roller 123 and the sheet P, the rotational direction of the first driven roller 123 becomes close to the traveling direction Q2 of the sheet P. As a result, the rotation of the sheet P is less likely to be obstructed because the load from the first driven rollers 123 to the sheet P is reduced, and hence the sheet P easily rotates.

Figure 6D:
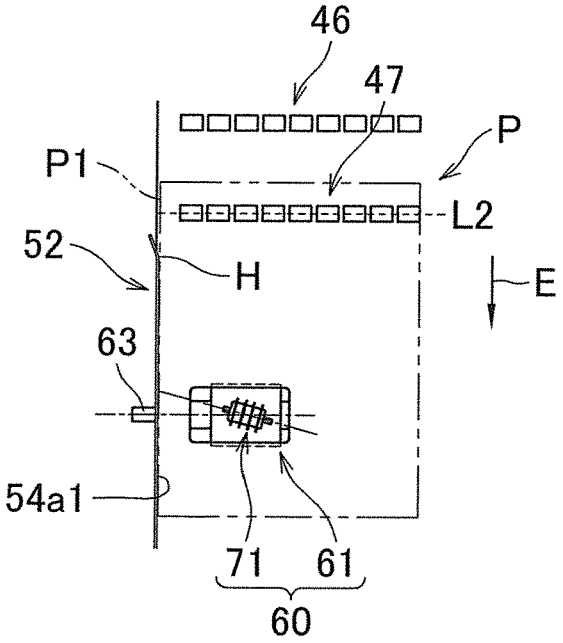
Figure 6D:
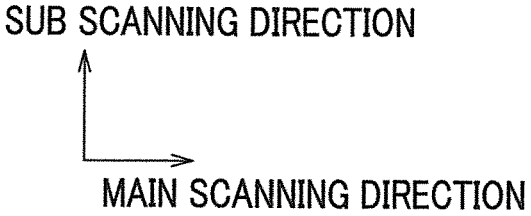

Subsequently, as shown in FIG. 6D, when the leading end of the sheet P contacts with the guide face 54*a*1, most of the side P1 contacts with the guide face 54*a*1. For this reason, the traveling direction of the sheet P conveyed by the position adjustment roller unit 60 and the first conveyor roller unit 47 becomes identical with the conveyance direction E. Furthermore, at this stage, by following the traveling direction (conveyance direction E) of the sheet P, the rotational axial line L2 of the first driven roller 123 changes its angle with respect to the supporting shaft 133 so that the rotational axial line L2 of the first driven roller 123 becomes in parallel to the axial line M1 of the drive roller 121. In other words, the angle θ2 is substantially 90 degrees (right angle). For this reason, at the contact point between the first driven roller 123 and the sheet P, the rotational direction of the first driven roller 123 becomes substantially identical with the traveling direction (conveyance direction E) of the sheet P. As a result, the load from the first driven rollers 123 to the sheet P is reduced. The sheet P is positioned in this way in the main scanning direction, and the sheet P in this state is conveyed in the conveyance direction E while the side P1 of the sheet P contacts with the entirety of the guide face 54*a*1.

As described above, in the printer 1 of the present embodiment, side registration, i.e., skew correction (positioning) performed by conveying the sheet P along the guide face 54*a*1 is carried out by utilizing the arrangement that the position adjustment roller unit 60 is closer to the guide face 54*a*1 than to the center (center line) of the conveyance path in the main scanning direction. In so doing, because the first driven rollers 123 are arranged to be swingable with respect to the supporting shafts 133, the first driven rollers 123 swing in accordance with the traveling direction of the sheet P when the sheet P is pinched by both the first conveyor roller unit 47 and the position adjustment roller unit 60. To be more specific, the first driven rollers 123 swing so that the axial line direction L2 of the first driven roller 123 becomes close to a direction orthogonal to the traveling direction of the sheet P. Such swing reduces the load from the first driven rollers 123 to the sheet P and hence the rotation of the sheet P is less likely to be obstructed, with the result that the sheet P easily rotates in the states shown in FIGS. 6B and 6C. Consequently, the side registration of causing the side P1 of the sheet P to be along the guide face 54*a*1 by the position adjustment roller unit 60 is less likely to be obstructed by the first conveyor roller unit 47.

In particular, when the sheet P is relatively long in the conveyance direction, the rotation of the sheet P is obstructed if the first driven rollers 123 do not swing, because the force of binding the sheet P by the first conveyor roller unit 47 is relatively large when the sheet P is pinched by the first conveyor roller unit 47. In other words, the side registration is likely to be obstructed when the sheet P is pinched by the first conveyor roller unit 47. When the tail end of the sheet P has just passed the first conveyor roller unit 47, most of the sheet P is on the downstream of the position adjustment roller unit 60 in the conveyance direction E, and hence the side registration is difficult. In this regard, according to the present embodiment, because the first driven rollers 123 are arranged to swing, the side registration is unlikely to be obstructed even if the sheet P is pinched by both the first conveyor roller unit 47 and the position adjustment roller unit 60, and hence the side registration is properly carried out even if the sheet P is relatively long in the conveyance direction. In other words, because the first driven rollers 123 are arranged to be swingable, the side registration is properly done no matter whether the sheet P is relatively short or relatively long in the conveyance direction.

In the above-described positioning operation of the sheet P, the second driven rollers 124 do not swing as the rotational axial line of each of these rollers is identical with the axial line M1 of the drive roller 121, and hence these rollers 124 are more likely to obstruct the rotation of the sheet P in the rotational directions F1 and F2, as compared to the first driven rollers 123. However, because the pressure from the second driven rollers 124 to the drive roller 121 is smaller than the pressure from the first driven rollers 123 to the drive roller 121 as described above, the obstruction of the rotation by the second driven rollers 124 is moderate, and hence the position adjustment is certainly carried out. Furthermore, each second driven roller 124 which is not provided with a spur has a smaller force of binding the sheet P in the rotational axial line than each first driven roller 123 provided with a spur. For this reason, the obstruction of the rotation by the second driven rollers 124 is moderate, and the position adjustment is certainly carried out.

In the present embodiment, the supporting shaft 133 inserted into each first driven roller 123 supports the first driven roller 123 to be rotatable about the shaft. The first driven rollers 123 are supported to be swingable with respect to the supporting shafts 133. As such, the structure in which the rotational axial line L2 of each first driven roller 123 swings is easily realized.

In addition to the above, according to the present embodiment, because the leading end of an annular protrusion 137, which is a part of the first support member 130, formed on the inner circumferential surface of the first driven roller 123, and faces the through hole 125*a*, functions as the fulcrum of the swinging of the first driven roller 123 and contacts with the outer circumferential surface of the supporting shaft 133, the fulcrum of the swinging of each first driven roller 123 is unchanged even if the first driven roller 123 is slightly deviated in the direction of the axial line of the supporting shaft 133. With this, the swinging of each first driven roller 123 is stabilized.

In addition to the above, in the present embodiment, because the first driven rollers 123 which are partial rollers separated from each other in the axial direction independently swing, resistance by which each first driven roller 123 is swung is relatively small as compared to a case where a single long roller is used as the first driven roller. For this reason, the side registration is further effectively carried out.

In addition to the above, in the present embodiment, the pressures from the first driven rollers 123 and the second driven rollers 124 to the drive roller 121 are smaller than the pressure from the upstream driven rollers 113 to the upstream drive roller 111. For this reason, the rotation of the sheet P becomes less obstructed as the conveyance force exerted by the first conveyor roller unit 47 is reduced, with the result that the side registration of the sheet P is further certainly carried out. In case of a sheet P which is relatively long in the conveyance direction and is equal to or longer than the distance between the second conveyor roller unit 46 and the position adjustment roller unit 60 in length, such a sheet P is successfully conveyed by a conveyance force of the second conveyor roller unit 46, even if the conveyance force exerted by the first conveyor roller unit 47 is small. On the other hand, in case of a relatively short sheet P in the conveyance direction which is shorter than the distance between the second conveyor roller unit 46 and the position adjustment roller unit 60, such a sheet P is successfully conveyed by a small conveyance force exerted by the first conveyor roller unit 47, because this sheet P is short and light.

In the present embodiment, because each of the first driven rollers 123 and upstream driven rollers 113 has at least one spur on the outer circumferential surface, these driven rollers 123 and 113 are less likely to slip on the surface of the sheet P. The sheet P is therefore more certainly conveyed.

Because the printer 1 includes a re-conveyance guide unit 3*c* which is the conveyor of the present embodiment in a re-conveyance unit, the lateral position of the sheet P is appropriate even when printing is performed on the back surface.

In the present embodiment, each upstream driven roller 113 is supported so as not to swing. On this account, the sheet P is conveyed in the conveyance direction E by the second conveyor roller unit 46. To restrain the occurrence of inappropriate conveyance of the sheet P, the second conveyor roller unit 46 preferably conveys the sheet P in the conveyance direction E. Provided that each upstream driven roller 113 is supported to be swingable in the same manner as the first driven rollers 123, the sheet P may be erroneously conveyed in a direction orthogonal to the conveyance direction E, when the sheet P is being conveyed by the first conveyor roller unit 47 and the second conveyor roller unit 46 before the sheet P is passed to the position adjustment roller unit 60. If the sheet P is conveyed in the direction orthogonal to the conveyance direction E before the sheet P is passed to the position adjustment roller unit 60, the sheet P may contact with a wall defining the conveyance path or the like in the main scanning direction, with the result that inappropriate conveyance such as jamming may occur. In the present embodiment, while each first driven roller 123 of the first conveyor roller unit 47 is supported to be swingable, each upstream driven roller 113 of the second conveyor roller unit 46 on the upstream of the first conveyor roller unit 47 in the conveyance direction E is supported not to be swingable. With this, the sheet P is conveyed in the conveyance direction E.

When the sheet Pmax is conveyed, the leading end of the sheet Pmax reaches the position adjustment roller unit 60 and then the tail end of the sheet Pmax passes the second conveyor roller unit 46. While the sheet Pmax is being conveyed by the second conveyor roller unit 46, each upstream driven roller 113 does not swing, and hence the sheet Pmax is conveyed in the conveyance direction E. After the tail end of the sheet Pmax passes the second conveyor roller unit 46, the sheet Pmax starts to rotate on account of the function of the position adjustment roller unit 60. At this stage, the sheet Pmax is pinched by the first conveyor roller unit 47. In this regard, because each first driven roller 123 of the first conveyor roller unit 47 is arranged to swing, the rotation of the sheet Pmax is unlikely to be obstructed.

When the sheet Pmin is conveyed, the leading end of the sheet Pmin reaches the position adjustment roller unit 60 after the tail end of the sheet Pmin passes the second conveyor roller unit 46 and before the tail end passes the first conveyor roller unit 47. Because each first driven roller 123 of the first conveyor roller unit 47 is supported to be swingable, the sheet Pmin starts to rotate due to the function of the position adjustment roller unit 60, when the leading end of the sheet Pmin reaches the position adjustment roller unit 60. Because each upstream driven roller 113 does not swing while the sheet Pmin is being conveyed by the second conveyor roller unit 46, the sheet Pmin is conveyed in the conveyance direction E.

Second Embodiment

Figure 7A:
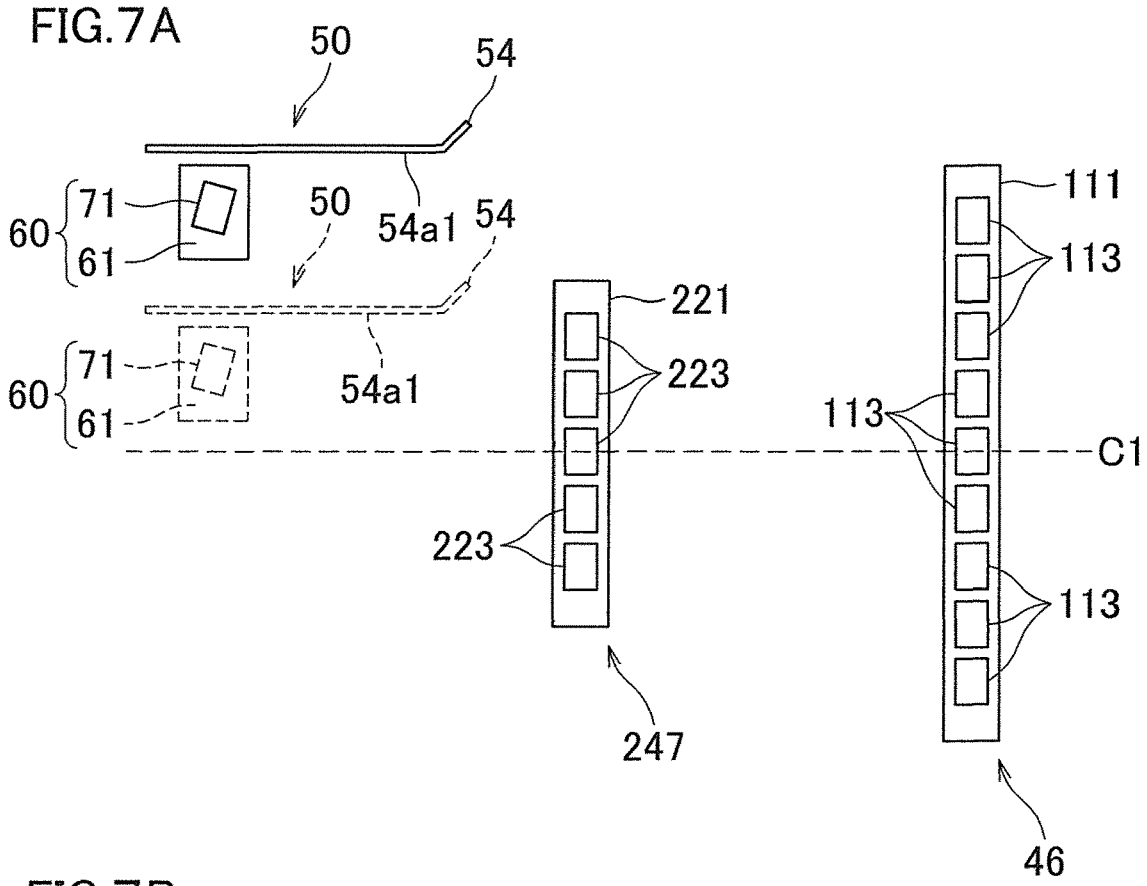
FIGS. 7A and 7B are virtual plan views which relate to Second and Third Embodiments of the present invention and are equivalent to FIG. 2.

Now, the following will mainly describe differences between the printer of First Embodiment and a printer including a conveyor of Second Embodiment of the present invention with reference to FIG. 7A. FIG. 7A is a virtual plan view which relates to Second Embodiment and is equivalent to FIG. 2, and does not illustrate spurs. In the description below, members identical with those in First Embodiment will be denoted by the same reference numerals and the explanations thereof will be omitted.

Second Embodiment is different from First Embodiment in the structure of the first conveyor roller unit. In Second Embodiment, as shown in FIG. 7A, a first conveyor roller unit 247 includes a drive roller 221 and five driven rollers (first driven rollers) 223. In the second embodiment, the drive roller 221 of the first conveyor roller unit 247 is shorter than the drive roller 111 of the second conveyor roller unit 46 and these drive rollers are positioned to be symmetrical with each other about the center line C1.

The drive roller 221 opposes five first driven rollers 223 which are partial rollers and are lined up at regular intervals to form a single line in the axial direction. These first driven rollers 223 are supported by a support member which is identical in structure with the above-described first support member 130 so that the rotational axial line of each first driven roller 223 is swingable. The center in the axial direction of the third first driven roller 223 which is the central one of the five first driven rollers 223 corresponds to the center in the axial direction of the fifth driven roller 113 which is the central one in the second conveyor roller units 46. These centers are on the center line C1.

As such, in the present embodiment, the center of the region in which the five first driven rollers 223 are provided corresponds in the axial direction to the center of the region in which the nine upstream driven rollers 113 are provided, and the region in which the five first driven rollers 223 are provided is shorter than the region in which the nine upstream driven rollers 113 are provided. Furthermore, in the present embodiment, the first conveyor roller unit 247 does not include a non-swinging second driven roller which is included in First Embodiment.

In the present embodiment, as with First Embodiment, the vertical portion 54 of the lower guide 52 and the position adjustment roller unit 60 are movable by an unillustrated mechanism in the main scanning direction in response to an operation by a user. For this reason, by moving the vertical portion 54 and the position adjustment roller unit 60 to positions indicated by full lines in case of a wide sheet P or to positions indicated by broken lines in case of a narrow sheet P, the position of the side edge of a sheet P on which printing is to be done is adjusted to correspond to the guide face 54*a*1.

A positioning operation for a sheet in the present embodiment is identical with the operation described with reference to FIGS. 6A to 6D in First Embodiment. That is to say, to begin with, the five first driven rollers 223 are inclined so that the angle θ2 becomes a right angle (see FIG. 6A), the first driven rollers 223 are then inclined so that the angle θ2 becomes an obtuse angle when the leading end of the sheet P reaches the position adjustment roller unit 60 (see FIG. 6B), the first driven rollers 223 are then inclined so that the angle θ2 becomes an acute angle when the side P1 of the sheet P contacts with the border line H (see FIG. 6C), and then the first driven rollers 223 are inclined so that the angle θ2 becomes a right angle when the leading end of the sheet P contacts with the guide face 54*a*1 (see FIG. 6D). In this way, in the present embodiment, as with First Embodiment, the side registration of causing the side P1 of the sheet P to be along the guide face 54*a*1 is less likely to be obstructed by the first conveyor roller unit 247.

Because the first driven rollers 223 swing so that the angle θ2 is serially changed in accordance with the conveyance of the sheet, the load from the first driven rollers 223 to the sheet P is reduced and the rotation of the sheet P is less likely to be obstructed, with the result that the sheet P easily rotates. The sheet P, however, still receives a small load from the first driven rollers 123. For this reason, the load from the first driven rollers 223 to the sheet P which is wider than five first driven rollers 223 in total in the positioning operation of the sheet is further reduced as compared to First Embodiment, by arranging the region in which the five first driven rollers 223 are provided as in the present embodiment to be shorter than the region in which the upstream driven rollers 113 are provided. This allows the side registration to be more smoothly performed. In the meanwhile, even if the conveyance force from the first conveyor roller unit 247 to the sheet is smaller than the conveyance force in First Embodiment, the sheet P which is not wider than the five first driven rollers 223 is light in weight, and hence a suitable conveyance force is exerted by the five first driven rollers 223, as the sheet P is adjusted with reference to the center and conveyed. Furthermore, the load to the sheet P is small because the non-swing second driven roller 124 in the first conveyor roller unit 47 of First Embodiment is not provided, and hence this arrangement is preferable in terms of smooth side registration. In the present embodiment, at least one of the five first driven rollers 223 may be a non-swing second driven roller described in First Embodiment. In this case, the second driven rollers are preferably arranged to be symmetrical with respect to the center line C1 to apply a symmetrical force onto the sheet.

Third Embodiment

Figure 7B:
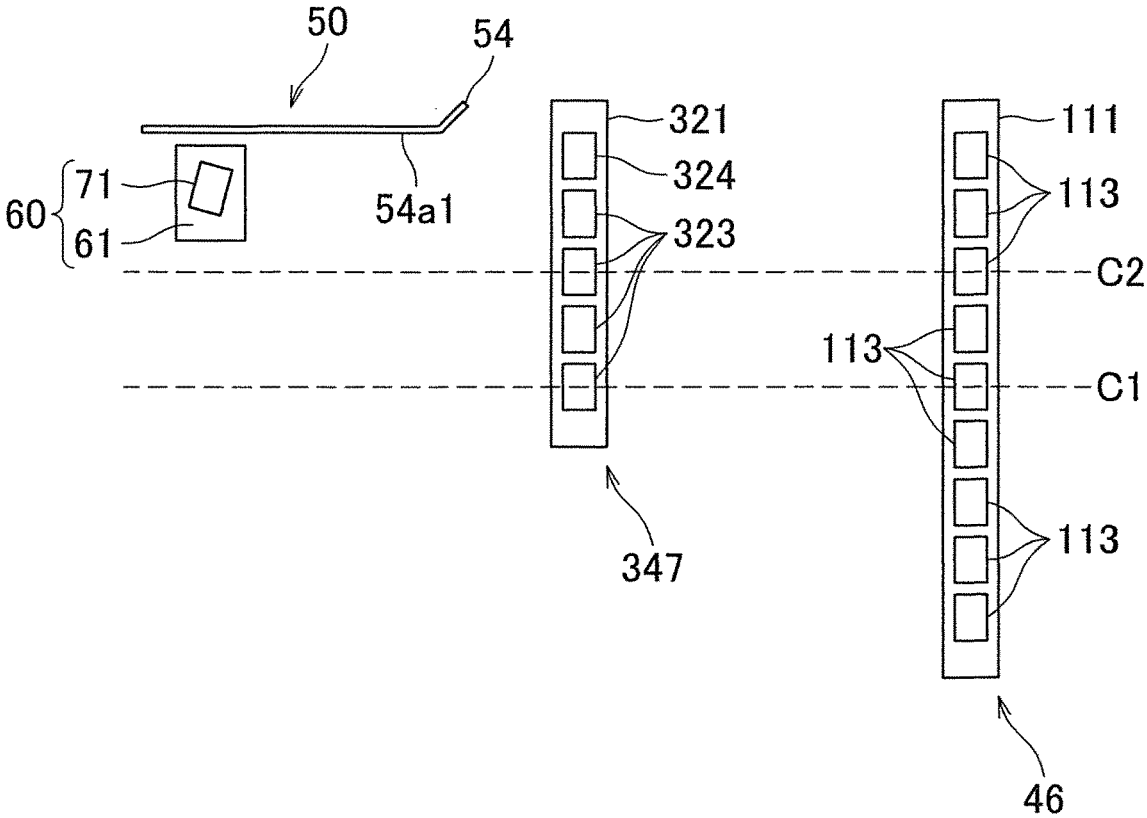

Now, the following will mainly describe differences between the printer of First Embodiment and a printer including a conveyor of Third Embodiment of the present invention with reference to FIG. 7B. FIG. 7B is a virtual plan view which relates to Third Embodiment and is equivalent to FIG. 2, and does not illustrate spurs. In the description below, members identical with those in First Embodiment will be denoted by the same reference numerals and the explanations thereof will be omitted.

In the first place, Third Embodiment is different from First Embodiment in the structure of the first conveyor roller unit. In Third Embodiment, a first conveyor roller unit 347 includes, as shown in FIG. 7B, a drive roller 321 and five driven rollers 323 and 324 which are lined up at regular intervals to form a single line in the axial direction. In the present embodiment, the drive roller 321 of the first conveyor roller unit 347 is shorter than the drive roller 111 of the second conveyor roller unit 46 and these rollers are arranged to be non-symmetrical with respect to the center line C1, more specifically, most of each roller is between the center line C1 and the guide face 54*a*1.

The drive roller 321 opposes the five driven rollers 323 and 324. The five driven rollers 323 and 324 are classified into four first driven rollers 323 which are partial rollers supported by a first support member to be swingable in the same manner as the first driven rollers 123 of First Embodiment and one second driven roller 324 which is supported by the first support member not to be swingable in the same manner as the second driven rollers 124 of the First Embodiment. The second driven roller 324 is positioned to be closest to the guide face 54*a*1 in the axial direction. Among the four first driven rollers 323, the first driven roller 323 farthest from the second driven roller 324 is arranged such that the center in the axial direction of this roller corresponds to the center line C1. Furthermore, the center in the axial direction of the driven roller 323 at the center of the five driven rollers 323 and 324 corresponds to the center in the axial direction of a driven roller 113 which is the third roller from the guide face 54*a*1 in the second conveyor roller unit 46. A linear line which passes this position and is in parallel to the center line C1 is indicated as C2 in FIG. 7B.

In the present embodiment, being different from First Embodiment, a sheet tray 24 is able to store sheets P which are adjusted with reference to the side edge (i.e., the position of the side edges of the stored sheets P corresponds to a virtual linear line which passes the guide face 54*a*1 and is in parallel to the center line C1). On this account, the vertical portion 54 of the lower guide 52 and the position adjustment roller unit 60 are fixed to be immovable. For example, in case of a prescribed large sheet P, the center in the width direction of the sheet P is on the center line C1 when the side edge of the sheet P contacts with the guide face 54*a*1, and in case of a prescribed small sheet P, the center in the width direction of the sheep P is on the linear line C2 when the side edge of the sheet P contacts with the guide face 54*a*1. The position adjustment roller unit 60 is closer to the guide face 54*a*1 than to the center line C1 and the linear line C2.

The positioning operation for the sheet in the present embodiment is identical with the positioning operation described in First Embodiment with reference to FIGS. 6A to 6D. That is to say, to begin with, the first driven rollers 323 are inclined so that the angle θ2 becomes a right angle (see FIG. 6A), the first driven rollers 323 are then inclined so that the angle θ2 becomes an obtuse angle when the leading end of the sheet P reaches the position adjustment roller unit 60 (see FIG. 6B), the first driven rollers 323 are then inclined so that the angle θ2 becomes an acute angle when the side P1 of the sheet P contacts with the border line H (see FIG. 6C), and then the first driven rollers 323 are inclined so that the angle θ2 becomes a right angle when the leading end of the sheet P contacts with the guide face 54*a*1 (see FIG. 6D). In this way, in the present embodiment, as with First Embodiment, the side registration of causing the side P1 of the sheet P to be along the guide face 54*a*1 is less likely to be obstructed by the first conveyor roller unit 347.

As the first driven rollers 323 swing to serially change the angle θ2 in accordance with the conveyance of the sheet, the load from the first driven rollers 323 to the sheet P is reduced and the rotation of the sheet P is less likely to be obstructed, with the result that the sheet P easily rotates. The sheet P, however, still receives a small load from the first driven rollers 323. For this reason, the load from the first driven rollers 323 to the sheet P which is wider than the total length of four first driven rollers 323 and one second driven roller 324 in the positioning operation of the sheet is further reduced as compared to First Embodiment, by arranging the region in which first driven rollers 323 and a second driven roller 324, the total number of which is five, are provided as in the present embodiment to be shorter than the region in which the upstream driven rollers 113 are provided. This allows the side registration to be more smoothly performed. In the meanwhile, even if the conveyance force from the first conveyor roller unit 347 to the sheet is smaller than the conveyance force in First Embodiment, the sheet P which is not wider than the total length of four first driven rollers 323 and one second driven roller 324 is light in weight, and hence a suitable conveyance force is exerted by the four first driven rollers 323 and the one second driven roller 324 as the sheet P is adjusted on the basis of the side edge and conveyed.

In addition to the above, the second driven roller 324 does not swing, and the rotational axial line thereof is always orthogonal to a virtual flat plane including the guide face 54*a*1. For this reason, even if the first driven rollers 323 swing for some reason so that the angle θ2 becomes not at 90 degrees before the leading end of the sheet P reaches the position adjustment roller unit 60 (i.e., the timing identical with the timing shown in FIG. 6A), the second driven roller 324 always applies a force by which the sheet P is conveyed in the conveyance direction E to the sheet P, with the result that the rotation of the sheet P or the movement of the sheet P in the main scanning direction before the leading end of the sheet P reaches the position adjustment roller unit 60 are restrained.

In addition to the above, because no spur is attached to the outer circumferential surface of the second driven roller 124 as described above in order to prevent the sheet P from being damaged, the second driven roller 124 tends to slip on the sheet P. In this regard, in the present embodiment, the outermost one of the five driven rollers 323 and 324, which faces a region which is likely to be a blank region where no image recording is performed by the head 2 in the sheet P irrespective of the size of the sheet P (in the present embodiment, a side edge closer to the guide face 54*a*1 in case of position adjustment with reference to the side edge), is selected as the second driven roller 324. For this reason, the occurrence of disturbance in the image is prevented even if the second driven roller 324 slips.

Fourth Embodiment

Figure 8:
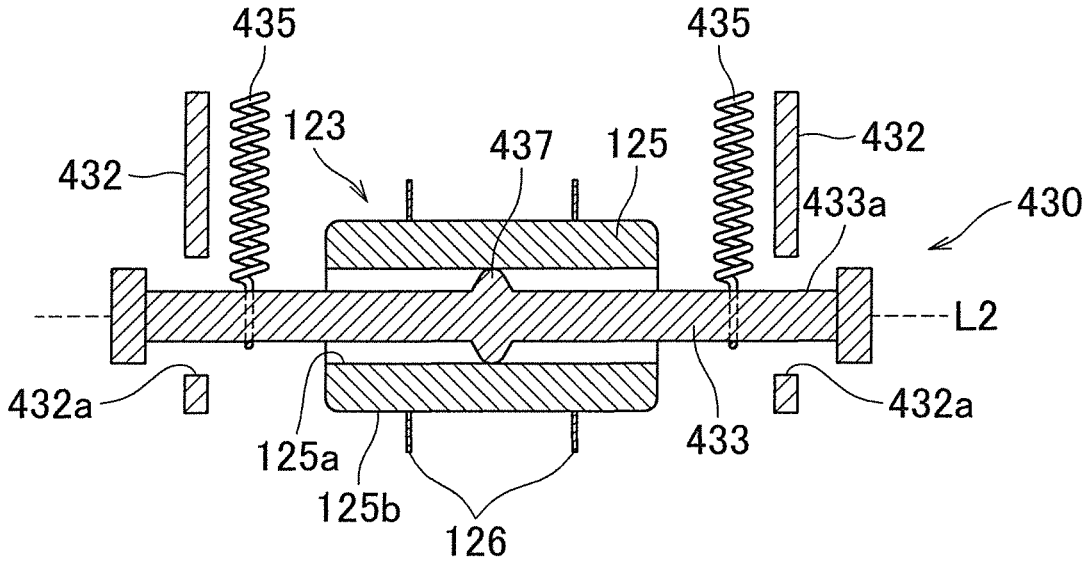
FIG. 8 is a cross section which relates to Fourth Embodiment of the present invention and is equivalent to FIG. 5A.

Now, the following will mainly describe differences between the printer of First Embodiment and a printer including a conveyor of Fourth Embodiment of the present invention with reference to FIG. 8. FIG. 8 is a cross section which relates to Fourth Embodiment and is equivalent to FIG. 5A. In the description below, members identical with those in First Embodiment will be denoted by the same reference numerals and the explanations thereof will be omitted.

Fourth Embodiment is different from First Embodiment in the structure of a part of a first support member which part supports first driven rollers 123. In the present embodiment, a first support member 430 supporting first driven rollers 123 includes nine supporter main bodies 131 (see FIG. 4) attached to the lower surface of an upper guide 51. On the lower surface of each supporter main body 131, a pair of flanges 432 is formed to protrude downward. In each flange 432, a long hole 432*a* which is narrow and long in the vertical direction is formed.

As shown in FIG. 8, the first support member 430 further includes, for each first driven roller 123, a supporting shaft 433 (shaft) which horizontally extends and a pair of coil springs 435 which are elastic members positioned between the supporter main body and the supporting shaft 433. The supporting shaft 433 is inserted into the long holes 432*a* at the both sides. The supporting shaft 433 is arranged to be vertically movable in the range of each long hole 432*a*. The coil springs 435 are connected to the supporter main body 131 and the supporting shaft 433 between the flanges 432 and the first driven roller 123.

As described in First Embodiment, each first driven roller 123 includes a cylindrical roller main body 125 in which a horizontally-extending through hole 125*a* is formed and two spurs 126 attached to the outer circumferential surface 125*b* of the roller main body 125. At a central part of the outer circumferential surface 433*a* of the supporting shaft 433 which part faces the through hole 125*a*, an annular protrusion 437 which is a part of the first support member 430 is formed to be integrated with the supporting shaft 433. The diameter of a circle formed by the leading end of the protrusion 437 is substantially identical with the inner diameter of the through hole 125*a*.

The supporting shaft 433 is inserted into the through hole 125*a* and the protrusion 437 contacts across 360 degrees with the inner circumferential surface of the first driven roller 123 facing the through hole 125*a*. In the meanwhile, the outer circumferential surface 433*a* of the supporting shaft 433 does not contact with the inner circumferential surface of the first driven roller 123, and a gap is formed therebetween. As a result, the leading end of the protrusion 437 functions as a fulcrum of the swing of the roller main body 125 with respect to the supporting shaft 433. That is to say, the first driven roller 123 is swingable about the leading end of the protrusion 437 to the extent that the inner circumferential surface of the first driven roller 123 does not contact with the outer circumferential surface 133*a* of the supporting shaft 433. Also in the present embodiment, the first support member 430 supports the seven first driven rollers 123 so that the rotational axial lines L2 (i.e., the central axes of the through holes 125*a*) of the first driven rollers 123 swing independently from one another. Furthermore, the supporting shaft 433 supports the roller main body 125 at the leading end of the protrusion 437 to be rotatable about the shaft. The positioning operation for the sheet in the present embodiment is identical with the positioning operation described with reference to FIGS. 6A to 6D.

In this way, in the present embodiment, because the supporting shaft 433 has the protrusion 437 functioning as a fulcrum of the swinging of the roller main body 125, the arrangement that allows the roller main body 125 to swing with respect to the supporting shaft 433 is easily realized. That is to say, because it is unnecessary to provide the protrusion 137 on the inner circumferential surface of the first driven roller 123, the manufacturing of the first support member 430 is simplified.

Fifth Embodiment

Figure 9:
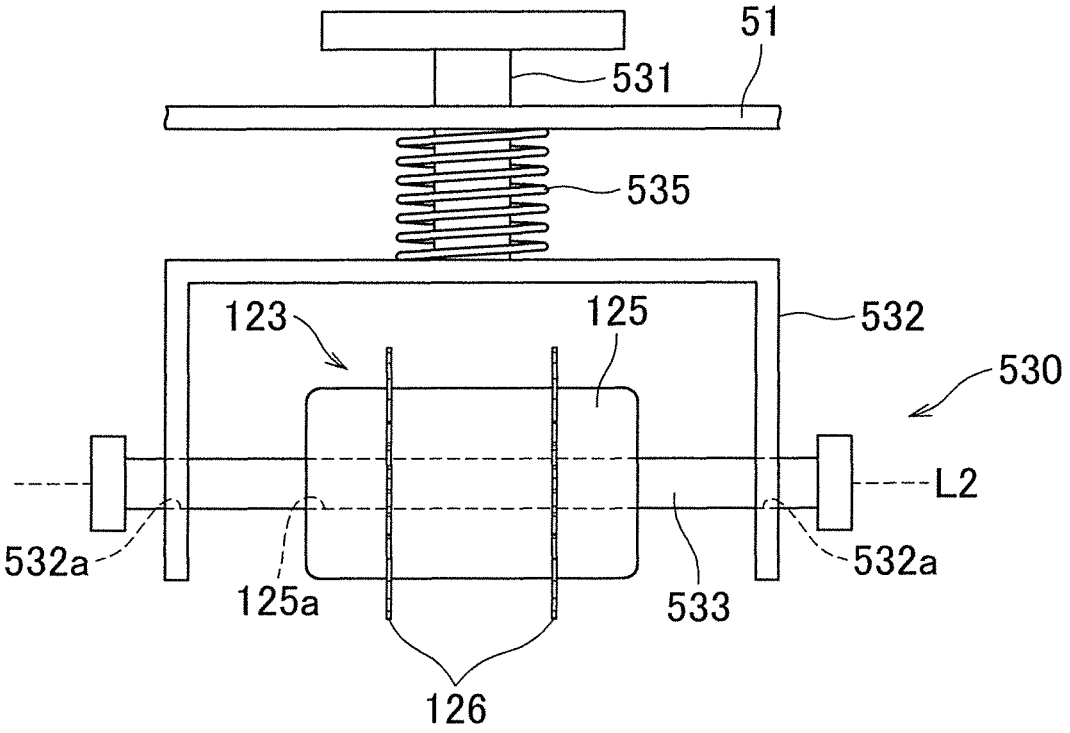
FIG. 9 is a profile which relates to Fifth Embodiment of the present invention and is equivalent to FIG. 5A.

Now, the following will mainly describe differences between the printer of First Embodiment and a printer including a conveyor of Fifth Embodiment of the present invention with reference to FIG. 9. FIG. 9 is a profile which relates to Fifth Embodiment and is equivalent to FIG. 5A. In the description below, members identical with those in First Embodiment will be denoted by the same reference numerals and the explanations thereof will be omitted.

In Fifth Embodiment, a first conveyor roller unit is not provided with the two second driven rollers 124 which are provided in First Embodiment, and nine first driven rollers 123 are lined up at regular intervals to form a single line in the axial direction. Fifth Embodiment is different from First Embodiment in the structure of the first support member. As shown in FIG. 9, a first support member 530 supporting nine first driven rollers 123 in the present embodiment includes nine attaching shafts 531 (only one of them is shown in FIG. 9) each vertically penetrating the upper guide 51, rotatably attached to the upper guide 51, and having an upper end portion which horizontally extends, and nine shaft retaining members 532 (only one of them is shown in FIG. 9) which is connected to the lower end of each attaching shaft 531 and has a U-shaped side surface which is open downward. In each of parts of the shaft retaining member 532 which parts vertically extend and oppose each other, a circular hole 532*a* is formed.

In addition to the nine attaching shafts 531 and the nine shaft retaining members 532, the first support member 530 further includes, for each first driven roller 123, a supporting shaft 533 (shaft) which horizontally extends and a coil spring 535 which is an elastic member positioned around the attaching shaft 531 and between the upper guide 51 and the shaft retaining member 532. The upper end of the coil spring 535 is fixed to the upper guide 51 whereas the lower end of the coil spring 535 is fixed to the shaft retaining member 532. The supporting shaft 533 is inserted into the holes 532*a* at the both sides.

As described in First Embodiment, each first driven roller 123 includes a cylindrical roller main body 125 in which a horizontally-extending through hole 125*a* is formed and two spurs 126 fixed to the outer circumferential surface 125*b* of the roller main body 125. In the present embodiment, the inner diameter of the through hole 125*a* is slightly longer than the outer diameter of the supporting shaft 533, and the supporting shaft 533 is inserted into the through hole 125*a*. With this, each first driven roller 123 is supported by the supporting shaft 533 so as not to swing with respect to the supporting shaft 533 and to be rotatable about the shaft.

When the first driven roller 123 contacts with the drive roller 121, the coil spring 535 biases the shaft retaining member 532 downward. On account of the biasing force of this coil spring 535, the pressure from the first driven roller 123 supported by the shaft retaining member 532 to the drive roller 121 via the supporting shaft 533 is generated.

In addition to the above, because the upper end of the coil spring 535 is fixed to the upper guide 51 whereas the lower end of the coil spring 535 is fixed to the shaft retaining member 532, the attaching shaft 531 receives a rotational force which is caused by the circumferential elastic force of the coil spring 535 to reversely rotate the attaching shaft 531 to return to the original angular orientation, and hence the attaching shaft 531 is rotated in one direction. When no external rotational force is exerted to the attaching shaft 531, the rotational axial line (the axis of the through hole 125*a* of each first driven roller 123) and the supporting shaft 533 are in parallel to the axial line M1 of the drive roller 121. By this elastic force of the coil spring 535, the first driven roller 123 swings in a horizontal plane (i.e., a plane including the axial line M1 of the drive roller and the conveyance direction) so as to rotate the attaching shaft 531 together with the supporting shaft 533 and the shaft retaining member 532. As a result, as with First Embodiment, the side registration of causing the side P1 of the sheet P to be along the guide face 54*a*1 is less likely to be obstructed by the first conveyor roller unit. Also in the present embodiment, the first support member 530 supports the nine first driven rollers 123 so that the rotational axial lines L2 (central axes of the through holes 125*a*) of the first driven rollers 123 independently swing.

Other Modifications

For example, the first driven rollers and the upstream driven rollers may not have spurs. Furthermore, the position adjustment roller unit 60 of the side position adjustment mechanism 50 may be positioned upstream or downstream of the guide face 54*a*1 in the conveyance direction E. Furthermore, the first driven rollers may not be arranged so that one roller main body is provided for one supporting shaft. Two or more roller main bodies may be provided for one supporting shaft. Furthermore, while each of the first driven rollers and upstream driven rollers has two spurs in the embodiments above, each roller may have one, three, or more spurs. Furthermore, the structure from the second conveyor roller unit 46 to the side position adjustment mechanism 50 in the re-conveyance guide unit 3*c* may be provided in the downstream guide unit 3*b*. In such a case, a sheet P having been positioned is ejected to the sheet output unit 4.

In addition to the above, the above-described embodiments may be altered as below. In the first conveyor roller unit 47, only one first driven roller 123 may be provided for one drive roller 121, and the length of the first driven roller 123 may be changed at will. The magnitude relationship between the pressures from the driven rollers to the drive rollers may be different from those described above and may be suitably changed. The first driven rollers 123 and the driven roller 71 (first position adjustment roller) may be provided in an opposite manner with respect to the sheet P. When the sheet leading end reaches the position adjustment roller unit 60, the sheet tail end may have already passed the pinching position of the second conveyor roller unit 46. Instead of arranging the positions of the vertical portion 54 of the lower guide 52 and the position adjustment roller unit 60 to be changeable, detachable units each of which includes these members and the distance from the center line C1 in each unit is different from the other units may be prepared, and the attached unit may be replaced with a suitable one in accordance with the size of a conveyed sheet. Alternatively, the position of the vertical portion 54 of the lower guide 52 may be changeable whereas the position of the position adjustment roller unit 60 may be fixed. The number and the positions of the second driven rollers may be changed. For example, as the second driven roller, a single driven roller in which the center thereof in the axial direction corresponds to the position of the center line C1 may be used. The second driven rollers are preferably positioned in a symmetrical manner with respect to the center line C1. In the axial direction, the region in the second conveyor roller unit in which region the upstream driven rollers are provided may be shorter than the region of the first conveyor roller unit in which the first driven rollers are provided. In Third Embodiment, all of the five driven rollers may be swingable first driven rollers 323. In Fifth Embodiment, the upper end of the coil spring 535 may not be fixed to the upper guide 51 and the lower end of the coil spring 535 may not be fixed to the shaft retaining member 532. That is to say, when the attaching shaft 531 is rotated in one direction, the rotational force of returning the attaching shaft 531 to the original angular orientation by means of the circumferential elastic force of the coil spring 535 may not be applied to the attaching shaft 531. The second support member may support the driven rollers (upstream driven rollers) of the second conveyor roller unit 46 to be swingable. The first support member may be arranged to be different from those described in the embodiments and modifications above, on condition that the first driven rollers are supported so that the rotational axial lines of the first driven rollers are swingable.

The conveyor of the present invention may be employed in an apparatus which is not a recording apparatus. When the conveyor is employed in the recording apparatus, the recording apparatus may be a line-type or a serial-type, and may be not only a printer but also a facsimile machine or a photocopier. As long as the recording apparatus performs image recording, the conveyor can be employed in any types of recording apparatuses such as laser-types and thermal types. The recording medium is not limited to the sheet P, and may be various types of recordable media.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a recording unit configured to record an image onto a sheet-shaped medium which is a recording medium;

a conveyance unit configured to convey the sheet-shaped medium to cause the sheet-shaped medium to pass a recording position where recording is carried out on the sheet-shaped medium by the recording unit; and a re-conveyance unit configured to re-convey, to a position before passing the recording position, the sheet-shaped medium having been conveyed by the conveyance unit and having passed the recording position, the re-conveyance unit including a conveyor, the conveyor comprising:

a first conveyor roller unit which includes a drive roller and a first driven roller which holds the sheet-shaped medium with the drive roller and is rotated in accordance with conveyance of the sheet-shaped medium by rotation of the drive roller, and a second driven roller which holds the sheet-shaped medium with the drive roller and is rotated in accordance with conveyance of the sheet-shaped medium by rotation of the drive roller;

a side position adjustment mechanism; and a first support member rotatably supporting the first driven roller to allow a rotational axial line of the first driven roller to be swingable in a plane parallel to the conveyance direction and to the axial direction in response to the conveyance of the sheet-shaped medium by the rotation of the drive roller, and the first support member rotatably supporting the second driven roller so that a rotational axial line of the second driven roller does not swing in the plane and is kept in parallel to the axial direction.

2. The recording apparatus according to claim 1, wherein, the first support member includes a shaft which is inserted into the first driven roller and supports the first driven roller to be rotatable about the shaft, and the first driven roller is supported to be swingable with respect to the shaft.

3. The recording apparatus according to claim 2, wherein, as a part of the first support member, an annular protrusion is formed on an inner circumferential surface of the first driven roller, and a leading end of the protrusion contacts with an outer circumferential surface of the shaft, as a fulcrum of swing of the first driven roller with respect to the shaft.

4. The recording apparatus according to claim 2, wherein, as a part of the first support member, an annular protrusion is formed on an outer circumferential surface of the shaft, and a leading end of the protrusion contacts with an inner circumferential surface of the first driven roller, as a fulcrum of swing of the first driven roller with respect to the shaft.

5. The recording apparatus according to claim 1, wherein, the first driven roller includes a plurality of partial rollers which are separated from one another in the axial direction, and the first support member supports the partial rollers to allow rotational axial lines of the respective partial rollers to independently swing in the plane.

6. The recording apparatus according to claim 1, wherein, a pressure from the second driven roller to the drive roller is smaller than a pressure from the first driven roller to the drive roller.

7. The recording apparatus according to claim 1, further comprising a second conveyor roller unit which is positioned upstream in the conveyance direction of the first conveyor roller unit and includes an upstream drive roller and an upstream driven roller which holds the sheet-shaped medium with the upstream drive roller and is rotated in accordance with conveyance of the sheet-shaped medium by rotation of the upstream drive roller.

8. The recording apparatus according to claim 7, further comprising a second support member which rotatably supports the upstream driven roller so that a rotational axial line of the upstream driven roller does not swing in the plane and is kept in parallel to a rotational axial line of the upstream drive roller.

9. The recording apparatus according to claim 7, wherein, a pressure from the first driven roller to the drive roller is smaller than a pressure from the upstream driven roller to the upstream drive roller.

10. The recording apparatus according to claim 7, wherein, in the axial direction, a region where the first driven roller is provided is shorter than a region where the upstream driven roller is provided.

11. The recording apparatus according to claim 7, wherein, each of the first driven roller and the upstream driven roller has at least one spur on its outer circumferential surface.

12. The recording apparatus according to claim 1, wherein, the second driven roller being positioned to oppose regions which are close to both side edges of the sheet-shaped medium.

13. The recording apparatus according to claim 1, wherein, the first support member includes a supporting shaft which is inserted into the second driven roller, and an inner circumferential surface of the second driven roller and an outer circumferential surface of the supporting shaft face each other with a constant gap in the axial direction so that the second driven roller is rotatable about the supporting shaft and is not swingable in the plane with respect to the supporting shaft.

* * * * *